US006135524A

United States Patent [19]

Faller et al.

[11] Patent Number: 6,135,524

[45] Date of Patent: Oct. 24, 2000

[54] STILTING FRAME

[75] Inventors: Alexander Faller, Rottenburger Str. 14, DE-84061 Ergoldsbach, Germany; Manfred Winklbauer, Ergolding, Germany

[73] Assignees: Alexander Faller, Ergoldsbach; Fritz Merk, Landshut; Heide Claudia Faller, Ergoldsbach, all of Germany

[21] Appl. No.: 08/945,186

[22] PCT Filed: Apr. 19, 1996

[86] PCT No.: PCT/EP96/01656

§ 371 Date: Jan. 2, 1998

§ 102(e) Date: Jan. 2, 1998

[87] PCT Pub. No.: WO96/33126

PCT Pub. Date: Oct. 24, 1996

[30] Foreign Application Priority Data

Apr. 20, 1995 [DE] Germany ..... 195 14 688
Dec. 20, 1995 [DE] Germany ..... 195 47 762

[51] Int. Cl.[7] ..... B66C 1/66

[52] U.S. Cl. ..... 294/81.1; 294/81.53

[58] Field of Search ..... 294/67.1, 81.1, 294/81.2, 81.21, 81.5, 81.52, 81.53, 110.2, 68.3; 410/77, 78, 82, 83; 414/137.1, 461, 607, 608, 626

[56] References Cited

U.S. PATENT DOCUMENTS

| | | | |
|---|---|---|---|
| 3,493,258 | 2/1970 | Wyrough | 294/81.1 X |
| 3,829,145 | 8/1974 | Gottlieb et al. | 294/81.1 X |
| 3,980,185 | 9/1976 | Cain | 294/81.53 |
| 4,341,495 | 7/1982 | Del'Acqua | 294/81.1 X |
| 4,358,145 | 11/1982 | Svensson | 294/81.53 X |
| 5,163,726 | 11/1992 | Boos et al. | 294/81.1 |
| 5,236,238 | 8/1993 | Barnett et al. | 294/81.1 X |

FOREIGN PATENT DOCUMENTS

| | | | |
|---|---|---|---|
| 150879 | 9/1981 | Germany . | |
| 4328635C1 | 9/1994 | Germany . | |
| 216485 | 9/1991 | Japan | 294/81.53 |
| 1676998 | 9/1991 | U.S.S.R. | 294/81.53 |

*Primary Examiner*—Johnny D. Cherry
*Attorney, Agent, or Firm*—Birch, Stewart, Kolasch & Birch, LLP

[57] ABSTRACT

The invention furnishes a stilting frame for the transport of containers by means of transhipment equipment, with the stilting frame being designed in such a way that in total four combined positions between the latch bolts of the transhipment equipment and the latch bolts of the stilting frame may be obtained from both switching positions of the latch bolts of the transhipment equipment. The stilting frame may thus be operated in a fully automatic manner and the operator may easily determine whether only the stilting frame is joined to the transhipment equipment, whether the container is also joined to the stilting frame, or whether or not all three elements are joined to each other.

28 Claims, 33 Drawing Sheets

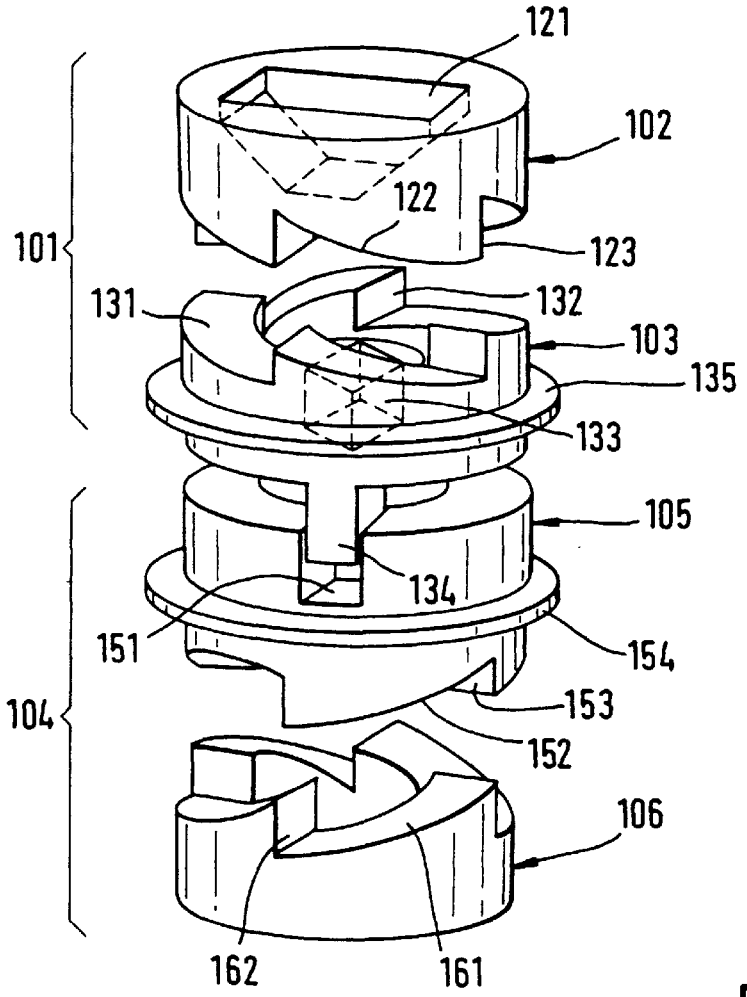
Fig. 5
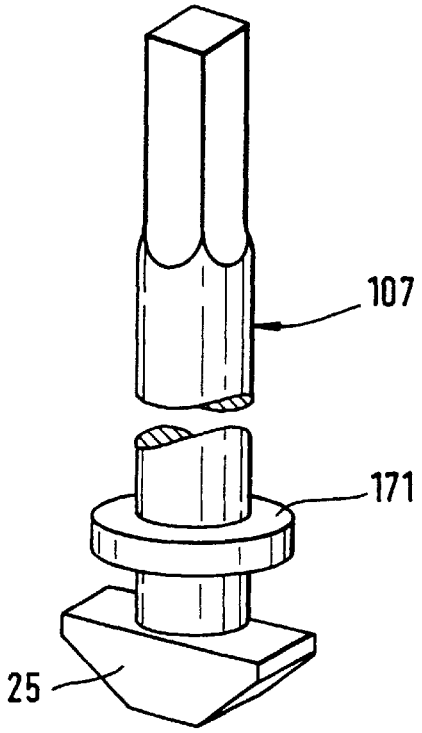

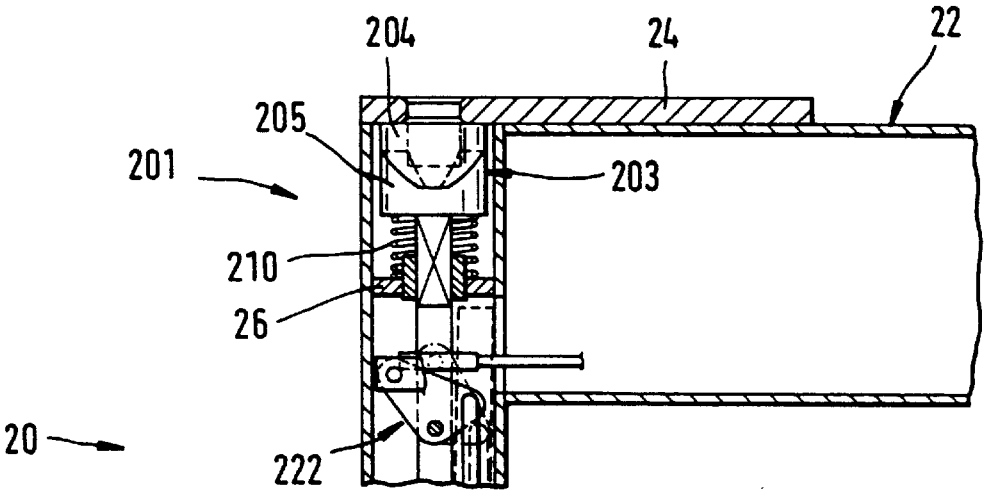
Fig.7
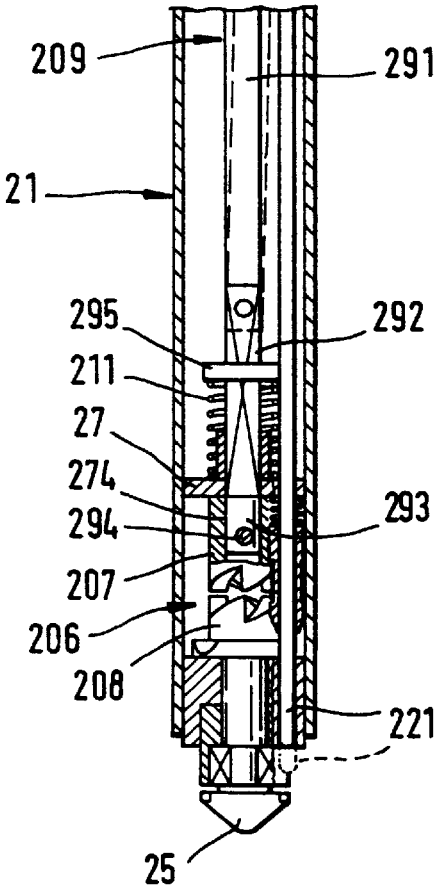

STILTING FRAME

BACKGROUND OF THE INVENTION

The invention relates to a stilting frame for the transport of containers provided with standardised corner castings to be engaged by latch bolts, or turn-lock fasteners, wherein the stilting frame includes corner posts, each of which comprises at its upper end a corner casting for a latch bolt of a transhipment equipment, and at its lower end a latch bolt for engaging a respective corner casting of a container arranged underneath, and wherein in at least one upper corner casting a switching member is arranged which may be rotated by the latch bolt of the transhipment equipment and can be operationally connected with the lower latch bolts.

RELATED ART

Adapter frames including such lock-on devices are employed for handling containers, in particular in harbors. The containers used there are frequently of the open-top type, such that the contents of the containers possibly extend above their upper edges, i.e. beyond the four top corner castings thereof. Thus these containers cannot be lifted and transported by using the customary transhipment equipment having only short post stumps at their corners inasmuch as the cargo prevents the transhipment equipment from being lowered by a sufficient amount. For this reason stilting frames are interposed between the container and the transhipment equipment.

Hitherto used stilting frames are mostly manually locked onto or disengaged from the container. Apart from the operator for the transhipment equipment, this requires a second person for manually operating the stilting frame.

In addition there are also fully automatic stilting frames which are, however, as a general rule of a very sophisticated design. Thus a stilting frame or overheight attachment including a storage frame is known e.g. from EP 608 254 A1. Automatically picking up or depositing this stilting frame by means of the transhipment equipment can only be performed in connection with the storage frame. Automated positioning on a container or in combination with a container is, however, not possible as latch hooks of the stilting frame remain locked with the transhipment equipment until actuating elements provided on the storage frame act upon them. This design furthermore requires a specific modification of the transhipment equipment as the locking portions for the latch hooks must additionally be arranged on the transhipment equipment.

DE 43 28 635 C1 discloses a stilting frame equipped with a hydraulic system. Its fully automated operation is achieved through the fact that, apart from the two rotary positions of the latch bolts of the transhipment equipment, three extended positions are provided. To this end, the vertical support columns of the stilting frame are adjustable telescopically. In the respective extended positions, the connections between the transhipment equipment and the stilting frame, or between the stilting frame and the container, respectively, may be established by means of a switching mechanism located inside the support columns. The synchronised hydraulic cylinders provided on each support column and coupled to each other ensure uniform telescopic adjustment of the support columns.

The telescopic design of the support columns does, however, suffer from the essential disadvantage of requiring a synchronising system to avoid tilting and ensure that the container will be picked up accurately. Expenditure in terms of construction is hereby increased substantially.

Moreover the hydraulic synchronising system itself presents more drawbacks with respect to reliability and upkeep of the stilting frame. Under practical circumstances the stilting frames are required to have a long service life and be virtually maintenance-free. For these reasons, maximum simplicity and operational safety are demanded from the construction of the stilting frames.

It is therefore the object of the invention to provide a stilting frame which has a simple construction while permitting fully automatic operation.

According to the invention, this object is attained in that the operational connection between the switching member and the latch bolts of the stilting frame is designed such that the set position of the stilting frame latch bolts is not affected when the at least one switching member is drivingly set to the unlocked position by the latch bolts of the transhipment equipment, whereas the stilting frame latch bolts are set to the respective alternative position when the latch bolts of the transhipment equipment are set to the locked position.

SUMMARY OF THE INVENTION

The design according to the invention permits four switching positions to the lock-on device for the stilting frame, whereby all necessary operational positions are covered. Thanks to a simple mechanical structure, the operator of the transhipment equipment is thereby enabled to operate the stilting frame without the aid of a second person. Actuation of the stilting frame lock-on device is performed through the rotating movements of the latch bolts of the transhipment equipment exclusively. Simple and fully automatic operation of the lock-on device is thus made possible.

In addition the resulting simple construction permits high operational safety and minimum maintenance requirements.

Thus the switching member is designed to be operable in either rotational direction. This is a great advantage inasmuch as the rotational direction of the latch bolts of handling devices can vary from case to case. Moreover, there may even be cases where the four latch bolts of a transhipment equipment have different rotational directions. The locking direction may thus be employed universally and without adaptation to the specifications of the transhipment equipment. The operation of the lock-on device for the stilting frame is thus ensured independently of the rotational directions of the latch bolts of the transhipment equipment.

It is furthermore an advantage that a drive mechanism interposed between the at least one switching member of the stilting frame and a control element for the latch bolts is systematically controlled in such a way that every second initiated movement of the switching member is converted into a switching movement of the stilting frame latch bolts. This drive mechanism makes it possible to convert a rotation in any direction into a rotating movement having a specified rotational direction. This allows for a plurality of switching positions.

In accordance with a first aspect of the invention, the system logic of the drive mechanism is established mechanically. As a result, the stilting frame is not susceptible to malfunction and can be provided independently of an external power supply. Thus, an assembly providing operational safety and long service life is made possible.

Due to the fact that the switching member includes a rotatable actuator and a linearly translatable control element, it becomes possible to convert the rotating movement of the latch bolts of the transhipment equipment into a linear movement. This linear movement has the purpose of enabling four positions of a stilting frame latch bolt starting out from the two positions of the transhipment equipment latch bolt. Actuation of the transhipment equipment latch bolts is therefore determined not only by the rotational position of the transhipment equipment latch bolts but furthermore by the position of the linearly translatable control element.

The complementary teeth of the inclined surfaces and horizontal surfaces of the actuator and of the control element of the switching member permit precise mutual engagement and thus good transmission of the actuating force. As the control element is designed to be merely linearly translatable, the inclined surfaces will slide on each other when the actuator is rotated. The control element, which is retained such as to be non-rotatable, is thereby translated linearly. The design of the actuator and of the control element including horizontal surfaces, moreover, ensures that the perfectly linear translation of the control element is attained even when the actuator is rotated by less than 90°. As a result, the perfectly linear translation is attained even when the transhipment equipment latch bolts are not capable of effecting an accurate rotation of the actuator, e.g. owing to wear.

Inasmuch as a spiral-jaw clutch arranged at the latch bolts of the stilting frame includes a driving member which can be translated linearly for driving and rotated as an interconnection as well as a rotatable switching member, defined actuation of the stilting frame latch bolts becomes possible. The linearly translatable driving member receives the linear translation of the control element of the switching members and transmits it to the switching member of the spiral-jaw clutch. Thus the linear translation is re-converted into a rotating movement of the stilting frame latch bolts. The driving member of the spiral-jaw clutch, which may furthermore be rotated for interconnection, moreover permits defined control of the switching member of the spiral-jaw clutch arid thus predefined actuation of the stilting frame latch bolts.

Inasmuch as the driving member and the control element of the spiral-jaw clutch each comprise complimentary teeth with inclined surfaces and vertical surfaces, actuation of the stilting frame latch bolts is achieved in the desired manner. Thanks to the inclined surfaces, the linear movement of the driving member can be converted into a rotating movement of the switching member and thus into a rotating movement of the stilting frame latch bolts. If, on the other hand, the linear translation is reset by actuating the switching member, further rotation of the switching member and thus of the stilting frame latch bolts will not take place due to the vertical surfaces on the spiral-jaw clutch.

As a slot is formed in the driving member of the spiral-jaw clutch at an angle with the vertical, limited rotation of the driving member of the spiral-jaw clutch becomes possible. As a result, the linear translation of the operational connection with the control element of the switching members and a transverse pin arranged on it is converted into the narrowly defined rotation of the driving member. Upon further linear translation of the control element or of the driving member, this enables a rotation in the opposite direction of the switching member of the spiral-jaw clutch, as a result of overlapping of the inclined surfaces of the spiral-jaw clutch. Hereby the latch bolt of the stilting frame in the corner casting of the container arranged underneath can be locked or unlocked.

As the switching member is designed to have a larger diameter than the spiral-jaw clutch, effective application of an actuating force on the latter is ensured. The larger diameter on the switching member allows for comparatively flat inclined surfaces and thus good transmission of force, to prevent jamming of the switching member or of the spiral-jaw clutch.

Owing to the fact that an engagable and disengagable connection is provided between the switching member and the spiral-jaw clutch or the latch bolt of the stilting frame, transmission of the actuating force to the spiral-jaw clutch can be enabled and disabled. Actuation of the latch bolts of the stilting frame may thus be prevented when the latter is seated on the container in an oblique or tilted condition. Faulty picking up of the container and an ensuing hazard to the cargo and to the health of personnel can thus be excluded.

Inasmuch as the connection can be engaged and disengaged by means of a control unit, secure picking up of the container is ensured. Where only one latch bolt of the stilting frame is not or insufficiently locked in the corner casting of the container, locking of the remaining latch bolts, which would result in the container being connected to the stilting frame and lifted at only three or less positions, is prevented. The control unit safeguards that the container will be picked up only if all of the latch bolts of the stilting frame are locked safely.

To this end, the control unit includes at each corner post an indicator pin and a lever mechanism, wherein the lever mechanisms of two corner posts are coupled to disks by means of transmission rods, which disks are in turn coupled to each other through coupling rods. It can be determined through the indicator pins whether the stilting frame rests correctly on the container, while the lever mechanisms or the transmission rods ensure that a connection between the stilting frame and the container will be established only when all of the indicator pins are actuated, i.e. when the stilting frame altogether is placed correctly on the container. Only then may secure picking up of the container by the stilting frame is ensured.

It is advantageous to provide the indicator pins and the transmission rods with spring means as otherwise, the components of the control unit would jam and result in damage, the reason being that the indicator pins or the transmission rods positively act on the disk. Such engagement with the notches of the disks can, however, only take place if they are in the correct rotational position. In case an indicator pin disengages from the container during lifting, the lever mechanism will cause the transmission rods to exert pressure on the rotary disk. The disks are in this case moreover, turned forcibly such that the transmission rods are locked into the notches of the disks as a result of the elastic force.

Providing the spring means of the indicator pins with a higher elastic force than that of the spring means of the transmission rods ensures that the effect of the indicator pins is transmitted to the disks. Thus, it is prevented that actuation of the indicator pin will be intercepted and neutralised by the spring means of the transmission rods.

Designing the connection between the control element of the switching member and the driving member of the spiral-jaw clutch as a pivotable push rod creates a simple mechanical structure providing high operational safety. In the absence of any further components, the linear translation of the control element of the switching member is thus transferred directly to the driving member of the spiral-jaw clutch.

Due to the fact that the push rods can be pivoted into their operative positions only if all of the indicator pins are pushed and therefore the transmission rods are released from the disks, it is ensured that the stilting frame rests correctly and completely on the container and all of the latch bolts of the stilting frame can be locked correctly.

The telescopic design of the coupling rods and/or of the transmission rods permits adaptation of the stilting frame to different container formats. The stilting frame may thus be adapted to the format of a container for universal application.

In accordance with another aspect of the invention, the logic of the drive mechanism includes a hydraulic switch and a mechanical switch. Herein, the drive mechanism transmits the forced movement of the switching member of the stilting frame only in the case where the hydraulic switch is activated and the mechanical switch is moved from a position corresponding to disengagement of the transhipment equipment into a corresponding engaging position.

This structure permits a very simple construction, and provides high operational safety. In addition, the stilting frame may thus be actuated fully automatically merely by actuating the latch bolts of the transhipment equipment. Additional intervention, e.g. manual intervention by operating personnel, is not required. The combination of a hydraulic switch and a mechanical switch makes use of the advantages of the respective designs to thereby increase reliability and compactness of the assembly. Furthermore, the simple construction makes it possible to subsequently adapt the drive mechanisms to traditional stilting frames. The mechanical switch comprises a cam plate which is coupled to a switching member of the stilting frame by means of a transmission member in such a way as to perform movement of the switching member equally upon locking and unlocking the latch bolts of the transhipment equipment, whereby effective transmission of this movement is ensured. The cam plate is designed such as to convert the rotating movement applied by the switching member into a translatory movement of the pushing member. Hereby, operationally safe conversion of a rotating movement into a translatory movement is achieved in a simple manner.

It is a further advantage if the cam plate is designed such that, starting out from the unlocked position of the switching member, it may be turned in either direction, to thereby be independent from the rotational direction of the latch bolt of the transhipment equipment.

As the pushing member comprises a pivotable portion, it may be pivoted into the operative position independently of the position of the indicator pins, i.e. independently from whether the stilting frame rests correctly on a container, or may be disengaged when not all of the indicator pins are pushed. Hereby, it is ensured that the stilting frame of the invention will only be locked to the container if the latch bolts on all four corners are correctly engaged with the respective corner casting of the container arranged underneath. This affords an essential contribution to security of the stilting frame.

Due to the fact that an engagement member, in particular a claw, engages with actuating elements, e.g. pins, of an actuator, the translatory movement of the pushing member can be converted into a rotating movement of the actuator. The actuating elements are arranged at a radial distance from the center of the rotatable actuator. Hereby, it is a achieved that the two-directional rotating movements of the switching members of the stilting frames can be converted into a rotating movement perpetuating a rotational direction. Furthermore, a simple mechanical structure of the drive mechanism is hereby made possible.

Actuation of a latch bolt of the stilting frame is achieved by transmitting the rotating movement applied to the actuator to the latch bolt. It is additionally of advantage if all of the latch bolts of the stilting frame are coupled to each other by means of a transmission member, e.g. a chain. This results in synchronous movement of the stilting frame latch bolts.

Moreover, the described drive mechanism in accordance with the second aspect of the invention permits a simple drive mechanism for the stilting frame latch bolts at low constructive expenditure, as merely one switching member in one corner of the stilting frame needs to be acted on by means of a latch bolt of the transhipment equipment to enable actuation of all the stilting frame latch bolts. The drive mechanism for this purpose is required only at one corner of the stilting frame to thereby further reduce the constructive expenditure.

It is a further advantage if the hydraulic switch is coupled to all of the indicator pins of the stilting frames via a control circuit and is activated when all of the indicator pins are pushed. Hereby, it is ensured that the stilting frame is connected to the container arranged underneath if all of the stilting frame latch bolts correctly engage the corner castings of the container.

It is a further advantage if pressure generation for the control circuit of the hydraulic switch is performed by a hydraulic cylinder which is also actuated by a switching member of the stilting frame. Thus, the stilting frame is autonomous also with respect to its hydraulic control, while further means for pressure generation are not required. This makes use of the fact that only one switching member of the stilting frame is required for actuating the mechanical switch, whereby the energy input upon rotation of another switching member of the stilting frame may be utilised for building up pressure in the control circuit. Actuation of the mechanical switch and pressure build-up for the hydraulic system may be performed by a single switching member or by various switching members of the stilting frames.

BRIEF DESCRIPTION OF THE DRAWINGS

The invention shall now be explained in detail by reference to embodiments in combination with the figures of the drawings, wherein:

FIG. 5 is an exploded perspective view of a first embodiment of the lock-on device of a stilting frame according to the present invention;

FIG. 7 is a sectional view of a corner post of a stilting frame according to the present invention with a representation of a second embodiment of the lock-on device;

DETAILED DESCRIPTION OF THE PREFERRED EMBODIMENTS

A stilting frame 20 in accordance with a first aspect of the invention comprising a purely mechanical lock-on device 10 (cf. FIG. 5) shall now be described.

Figure 1:
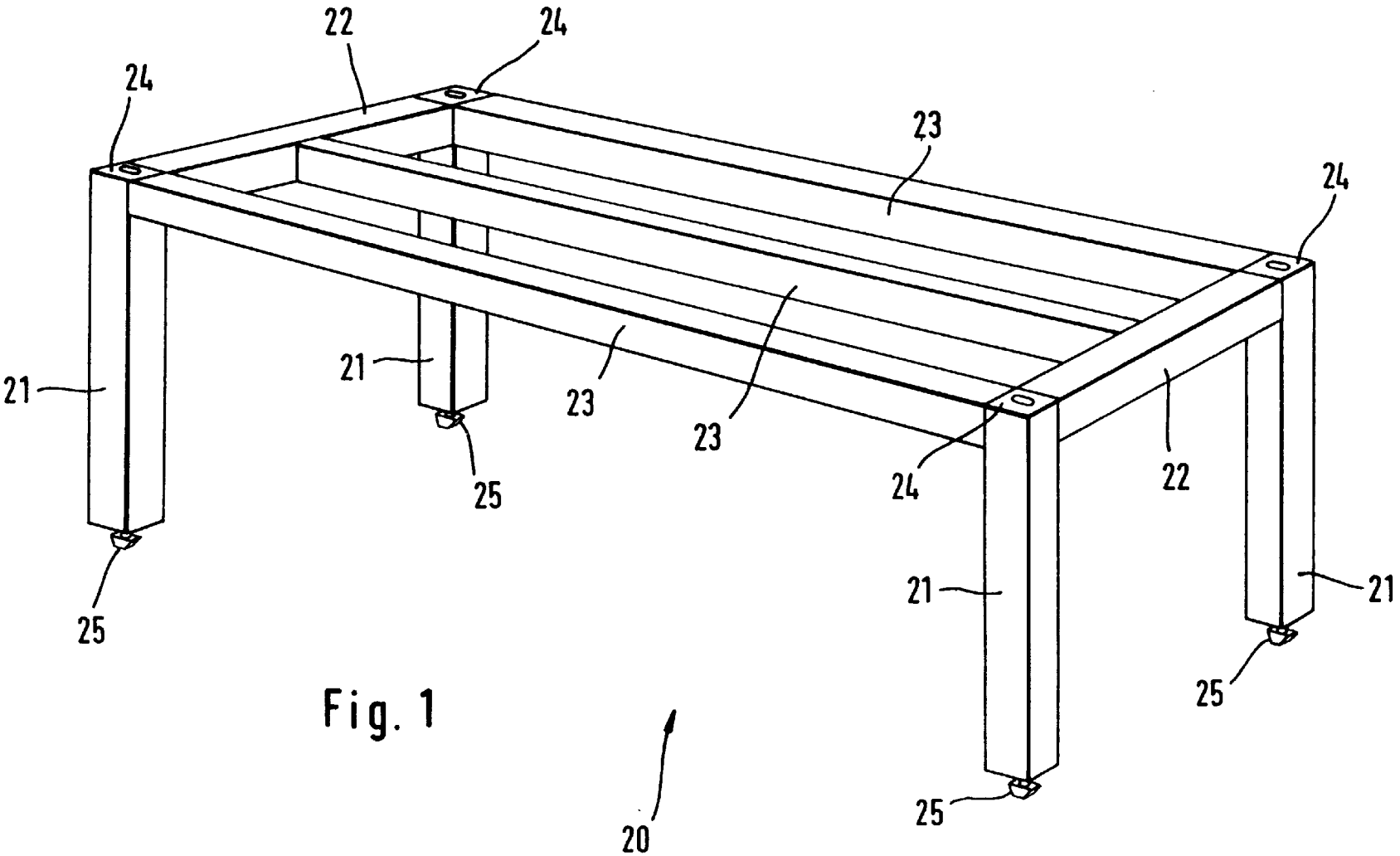
FIG. 1 is a perspective view of a stilting frame in accordance with the present invention.
Figure 2:
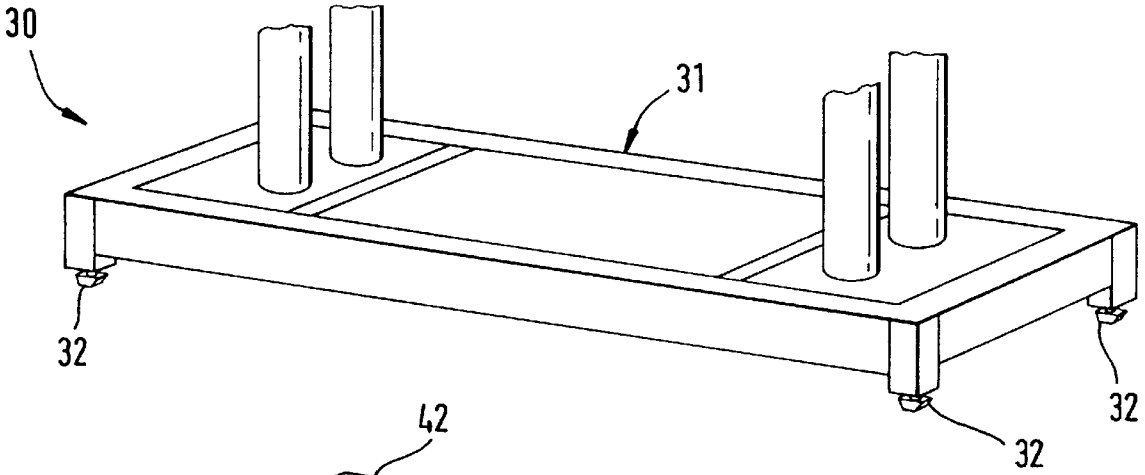
Fig. 2 PRIOR ART
FIG. 2 is a perspective view of a conventional transhipment equipment (spreader)
Figure 3:
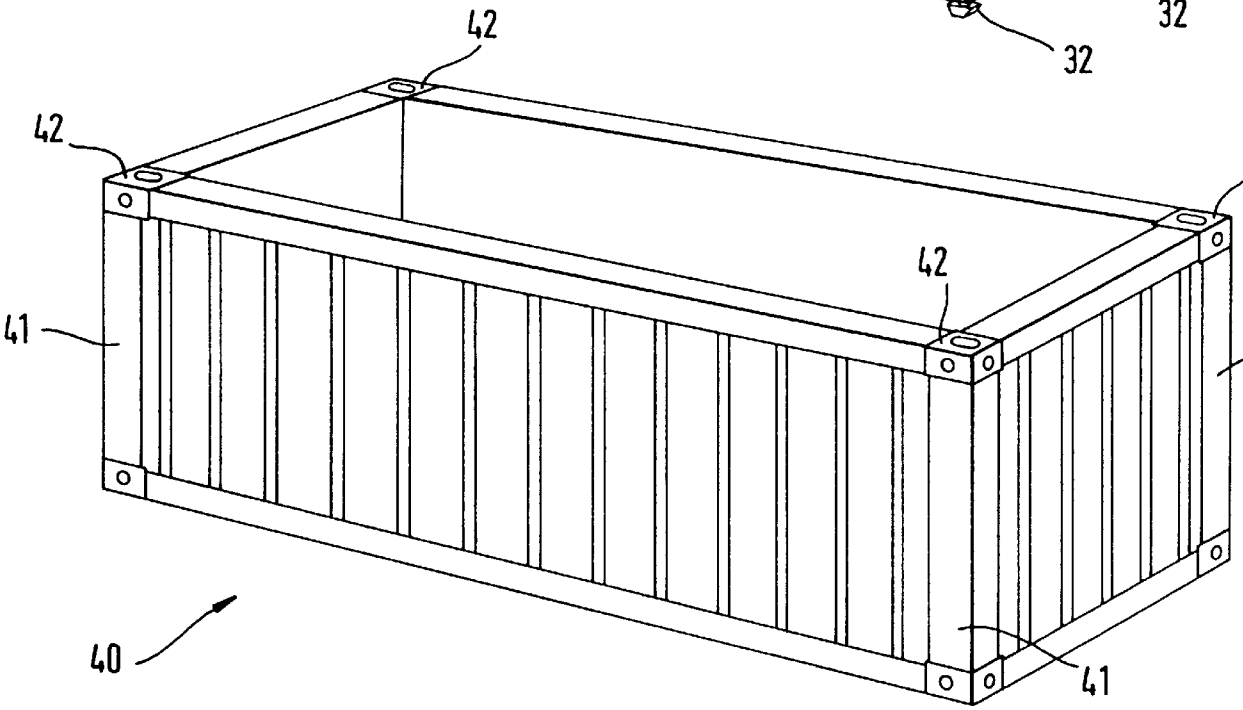
Fig. 3 PRIOR ART
FIG. 3 is a perspective view of a conventional container.

A lock-on device 10 is arranged in a stilting frame 20. When necessary, the stilting frame 20 is coupled to a transhipment equipment (spreader) 30 enabling it to pick up containers 40 who se cargo projects beyond the upper edges (cf. FIGS. 1, 2 and 3).

The stilting frame 20 includes four corner posts 21 as well as transverse members 22 and side rails 23. At the upper ends of the corner posts 21 corner castings 24 are provided.

The transhipment equipment 30 has a flat frame 31. At each corner of the frame 31 a latch bolt (twist-lock) 32 operable by the operator of the transhipment equipment is arranged.

Figure 4:
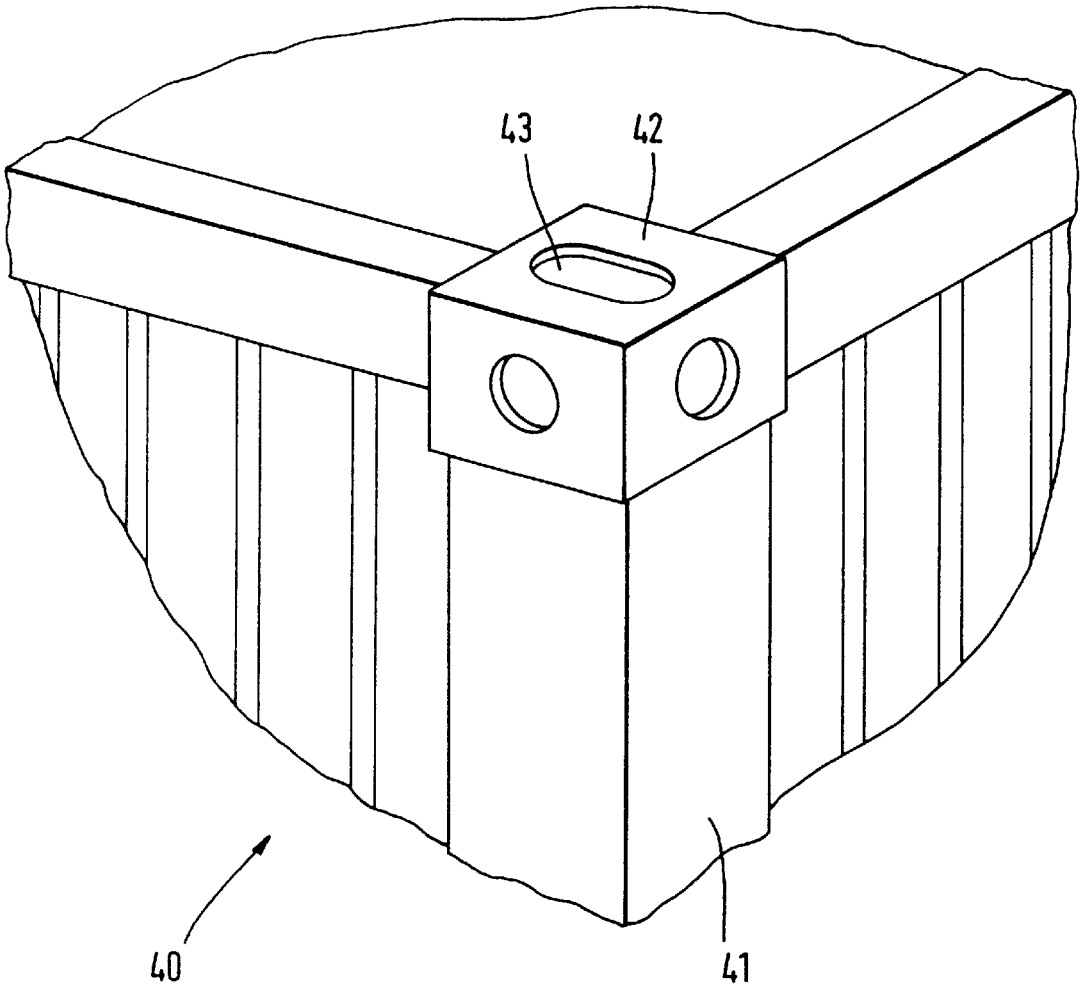
Fig.4 PRIOR ART
FIG. 4 is a perspective view of a corner zone of a conventional container with a corner casting.

The container 40 is open at the top and comprises corner castings 42 in the upper area of its corner posts 41 (cf. FIG. 4). The corner castings 42 are each provided with a slot 43 permitting the latch bolt 32 of the transhipment equipment 30 or the latch bolt 25 of the stilting frame 20 to project through it and engage the corner casting.

In operation, the transhipment equipment 30 generally picks up the container 40 directly. To this end, the latch bolts 32 of the transhipment equipment 30 engage in the corner castings 42 of the container 40 through the slots 43 and are actuated by the operator of the transhipment equipment 30 such that the latch bolts 32 rotate by 90 degrees and thus create positive coupling of the container 40 to the transhipment equipment 30.

As open-top containers 40 or flat transport pallets are used in many cases, there is also the case where the cargo inside the container projects beyond its upper edge. Because the transhipment equipment 30 has a flat frame 31, the latter can under certain circumstances not reach the corner castings 42 of the container 40 as the flat frame 31 is blocked by the cargo. Therefore a stilting frame 20 is coupled to the transhipment equipment 30 in the manner of a container 40, after which the stilting frame 20 is then connected to the container 40.

In accordance with the present invention, actuation of the latch bolt 32 of transhipment equipment 30 via the lock-on device 10 in the stilting frame 20 is transmitted to latch bolts 25 of the stilting frame 20 in such a way that they positively engage and lock on the corner castings 42 of the container 40.

Thus the stilting frame 20, together with the container 40 coupled to it, can be lifted by the transhipment equipment 30 and taken away for further loading, e.g. onto a boat.

The operation of the lock-on device 10 according to the invention shall be described below by referring to a first embodiment.

In accordance with the representation of FIG. 5 the lock-on device 10 comprises a switching member 101 having an actuator 102 and a control element 103. A spiral-jaw clutch 104 is in positive connection with the switching member 101 and includes a driving member 105 and a switching member 106. The control element 103 is in positive connection with a drive shaft 107 on which the latch bolt 25 of the stilting frame 20 is arranged.

Figure 6:
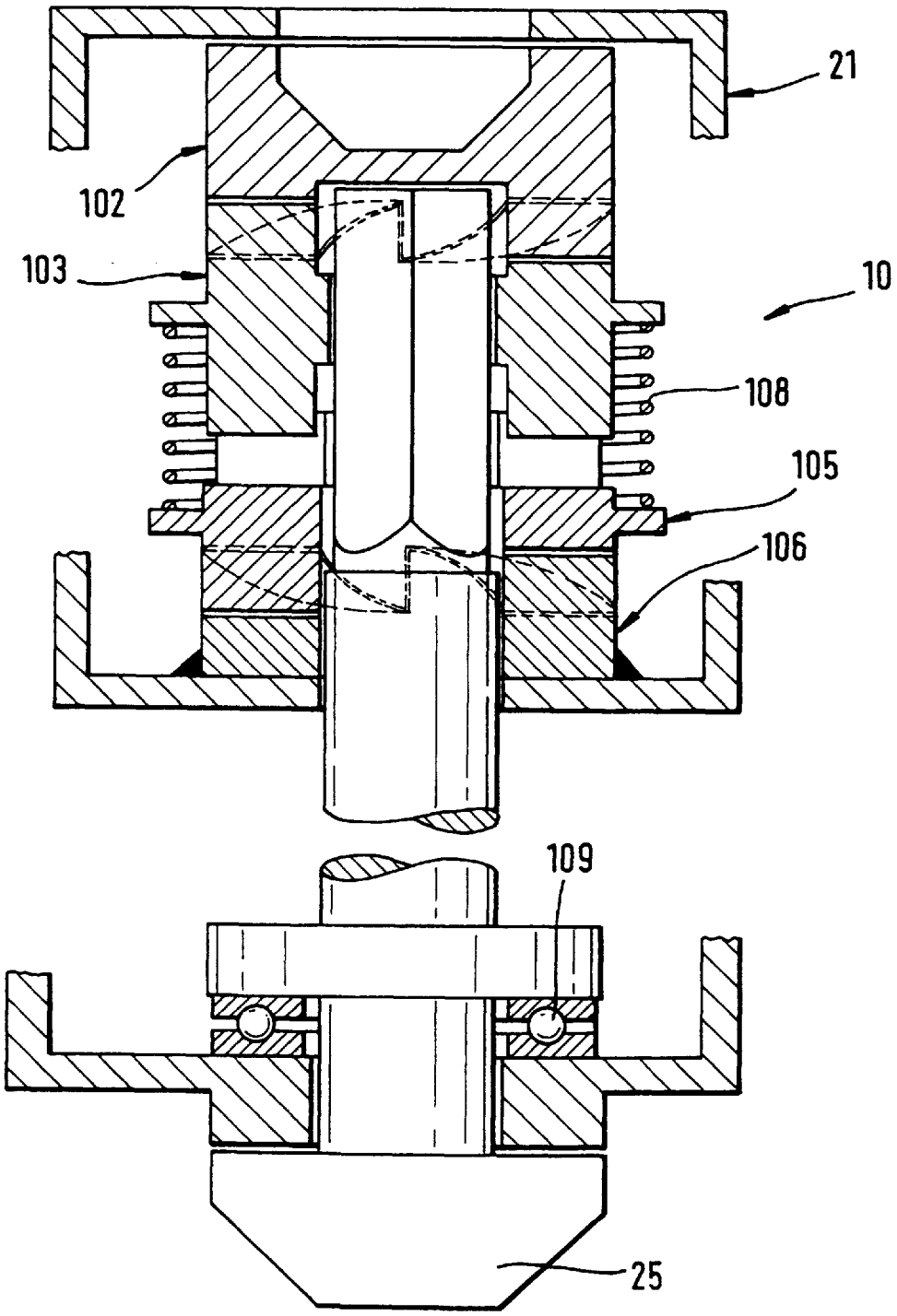
FIG. 6 is a sectional view of the first embodiment of the lock-on device according to FIG. 5.
Figures 8A, 8B, 8C, 8D:
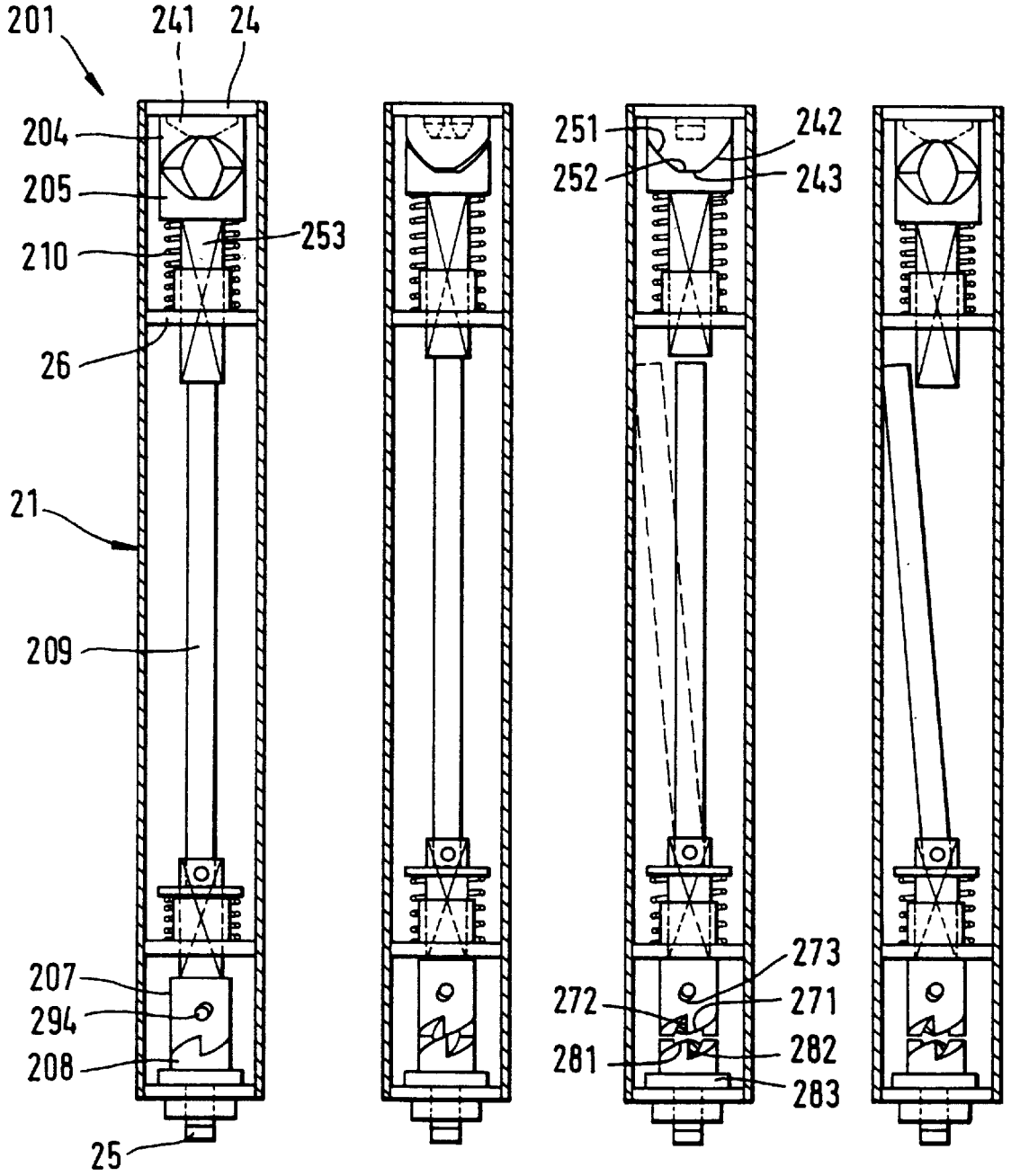
FIG. 8A is a schematic representation of the second embodiment of the lock-on device in a position in which the stilting frame is coupled to the transhipment equipment.
FIG. 8B shows, in a representation corresponding to the one of FIG. 8A, the lock-on device in a position wherein neither the container nor the transhipment equipment is coupled to the stilting frame, and wherein the latch bolt of the transhipment equipment is rotated by a sufficient amount to bring the inclined surfaces of a spiral-jaw clutch into contact with each other.
FIG. 8C shows, in a representation corresponding to the one of FIG. 8A, the lock-on device in a position wherein the stilting frame is coupled neither to the transhipment equipment nor to the container.
FIG. 8D shows, in a representation corresponding to the one of FIG. 8A, the lock-on device in a position wherein the stilting frame is coupled to the transhipment equipment but not to the container.
Figures 9A, 9B, 9C:
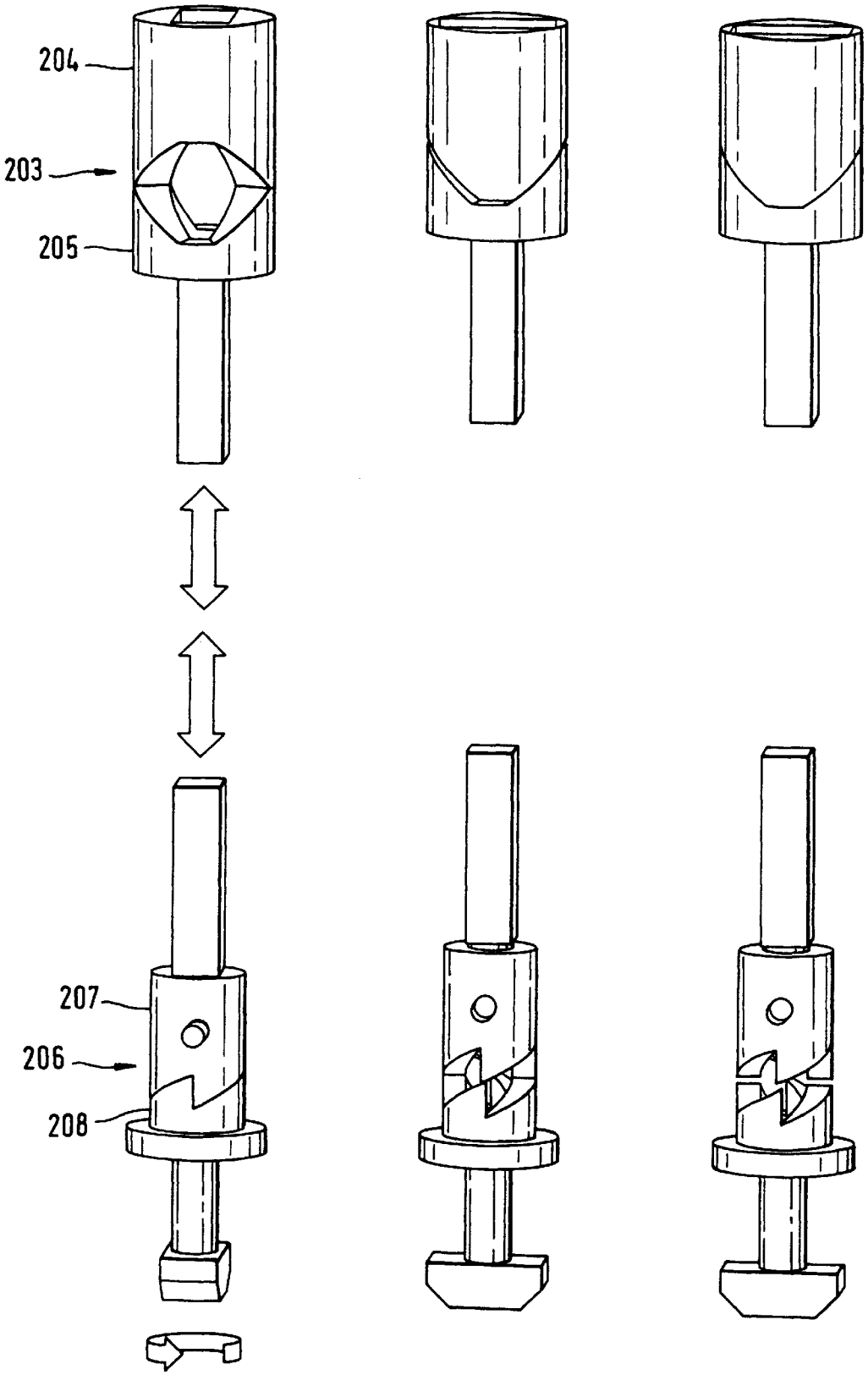
FIG. 9A is a perspective view of the second embodiment of the lock-on device in a position wherein the stilting frame is coupled both to the transhipment equipment and to the container.
FIG. 9B shows, in a representation corresponding to the one of FIG. 9A, the lock-on device in a position wherein the latch bolt of the transhipment equipment is rotated by a sufficient amount to bring the inclined surfaces of the spiral-jaw clutch into contact with each other.
FIG. 9C shows, in a representation corresponding to the one of FIG. 9A, the lock-on device in a position wherein the stilting frame is coupled neither to the transhipment equipment nor to the container.

The lock-on device 10 is arranged in each corner post 21 of the stilting frame 20 as is shown in FIG. 5 and FIG. 6, respectively.

The actuator 102 includes a depression 121 adapted to the latch bolt 32 of the transhipment equipment 30, as well as inclined surfaces 122 and vertical surfaces 123. These have a shape complementary with inclined surfaces 131 and vertical surfaces 132 on the control element 103. The control element 103 moreover includes a square recess 133 in its center and a projection 134 in the lower area.

The spiral-jaw clutch 104 is designed as a safety against reverse rotation of the switching member 101. To this end, the driving member 105 includes notches 151 that receive the projection 134 on the control element 103. Moreover, the driving member 105 is also provided with inclined surfaces 152 and vertical surfaces 153. The switching member 106 is provided with complementary inclined surfaces 161 and vertical surfaces 162.

The control element 103 and the driving member 105 moreover each include a ring 135 and 154 having the function of a stopper for a coil spring 108.

The drive shaft 107 comprises a ring 171 serving as a stay for a bearing 109.

The operation of the lock-on device 10 in accordance with the first embodiment shall be described below.

The latch bolt 32 of the transhipment equipment 30 engages depression 121 of the actuator 102. When the latch bolt 32 is actuated by the operator of the transhipment equipment 30, the actuator 102 rotates by 90 degrees to drivingly engage the control element 103 owing to the complementary teeth. As the drive shaft 107 is positively coupled to the control element 103, the latch bolt 25 of the stilting frame 20 is also rotated by 90 degrees. The stilting frame 20, is thus joined to the transhipment equipment 30, and so is a container 40 if arranged underneath it.

When the latch bolt 32 of the transhipment equipment 30 is turned back or unlocked, only the actuator 102 rotates in the opposite direction. This is achieved by the fact that the control element 103 is positively coupled to the driving member 105 of the spiral-jaw clutch, or to the safety 104, and the teeth at the spiral-jaw clutch 104 are formed opposite the teeth of the switching member 101. The control element 103 is thus kept in its rotational position by the vertical surfaces 153 and 162 of the driving member 105, or of the stationary switching member 106. Consequently, the drive shaft 107 is also not rotated, and the latch bolt 25 of the stilting frame 20 remains locked to the container 40.

The transhipment equipment 30 is thus not locked to the stilting frame 20 any more and can be lifted off. The container 40, on the other hand, remains coupled to the stilting frame 20. This is a case not frequently demanded under practical circumstances, if the container 40 and the stilting frame 20 are to be picked up jointly by another transhipment equipment.

If the latch bolt 32 of the transhipment equipment 30 is, in turn, locked to the stilting frame 20, then the actuator 102, the control element 103 and the driving member 105 jointly rotate. The driving member 105 in turn locks on the stationary switching member 106. The drive shaft 107, and thus the latch bolt 25 of the stilting frame 20, are rotated via the control element 103 to thereby disengage the locking connection between the stilting frame 20 and the container 40.

In this position the stilting frame 20 is coupled to the transhipment equipment 30 while being disengaged from the container 40. The stilting frame 20 can then be lifted off the container 40 and set down or placed on another container 40.

Renewed unlocking of the latch bolt 32 of the transhipment equipment 30 does, however, not affect the latch bolt 25 of the stilting frame 20 inasmuch as the control element 103 and the driving member 105 are being retained by the stationary switching member 106.

The stilting frame 20 is thus disengaged from the transhipment equipment 30 and may be set down.

As a result, four positions of the lock-on device 10 according to the invention are realised, which are set only by the latch bolt 32 of the transhipment equipment 30. Fully automatic operation and control by a single person, the operator of the transhipment equipment 30, is thereby made possible.

The lock-on device 10 of the stilting frame 20 shall be explained below by referring to a second embodiment (cf. FIGS. 7 to 18).

The lock-on device 10 essentially includes one actuating means 201 arranged in each corner post 21 of the stilting frame 20 and a control unit 202.

The actuating means 201 includes a switching member 203 comprising an actuator 204 and a control element 205 as well as a spiral-jaw clutch 206 which comprises a driving member 207 and a switching member 208. The control element 205 of the switching member 203 is connected to the driving member 207 of the spiral-jaw clutch 206 via a push rod 209. This push rod 209 can be engaged with and disengaged from the control element 205 by means of control unit 202.

The actuator 204 of the switching member 203 is provided with a depression 241 which matches the latch bolt 32 of the transhipment equipment 30. Furthermore the actuator 204 comprises inclined surfaces 242 and horizontal surfaces 243.

These are formed to be complementary with the inclined surfaces 251 and horizontal surfaces 252 of the control element 205. The lower area of the control element 205 has the form of a square section 253. Thus, the control element 205 is held positively and non-rotatably in a flange portion 26 of the corner post 21 of the stilting frame 20. A spring 210 is arranged in the corner post 21 such as to press the switching member 203 upwardly against the corner casting 24.

The driving member 207 of the spiral-jaw clutch 206 is provided with inclined surfaces 271 and vertical surfaces 272. These are formed to be complementary with inclined surfaces 281 and vertical surfaces 282 of the switching member 208. The driving member 207 moreover comprises an oblong recess 273 extending transversely through the cylindrical driving member 207 and extending at an angle with the vertical. A bore 274 furthermore extends from above into the driving member 207 such as to pass through the oblong recess 273.

The switching member 208, apart from the inclined surfaces 281 and the vertical surfaces 282, includes a flange portion 283 and is fixedly connected to the latch bolt 25 of the stilting frame 20.

The push rod 209 is essentially comprised of a pivoting portion 291, a square portion 292 and a round portion 293. The pivoting portion 291 is pivotally coupled to the square portion 292 and is actuated by means of the control unit 202. The round portion 293 projects into the bore 274 of the driving member 207, whereby the latter can be rotated. A pin 294 provided on the round portion 293 extends on either side into the oblong recess 273 of the driving member 207 to control the rotational and longitudinal movements thereof. The square portion 292 is held non-rotatably in another flange portion 27 in the corner post 21 of the stilting frame 20 and furthermore comprises a flange 295 serving as another stop surface for a spring 211 in addition to the flange portion 27. The flange portion 27, moreover, limits the linear mobility of the driving member 207 in an upwardly direction.

The switching member 203 is formed to have a greater diameter than the spiral-jaw clutch 206 for the effective transmission of movements. The relatively large diameter of the actuator 204 and of the control element 205 of the switching member 203 permits a small gradient of the inclined surfaces 242 and 251. Thus the latter slide more easily on each other to avoid jamming of the control element 205 in the corner post 21 of the stilting frame 20, as a result of transverse forces. In addition, owing to the greater diameter of the switching member 203, a higher force is transmitted via the applied torque to the spiral-jaw clutch 206 to avoid jamming owing to frictional forces.

The control unit 202 comprises in each corner post 21 of the stilting frame 20 an indicator pin 221 and a lever mechanism 222 coupled to it. First and second transmission rods 223 and 224 in each transverse member 22, which are coupled thereto, act on two coupled disks 225 and 226. The coupled disks 225 and 226 in the respective transverse members 22 at the two longitudinal ends of the stilting frame 20 are in turn connected with each other through a coupling rod or coupling shaft 227 in a side rail 23 of the stilting frame 20. This is to ensure that the lock-on devices 10 in the respective corner posts 21 of the stilting frame 20 will interact in a co-operating manner.

Actuating rods 228 eccentrically mounted on the disks 225 and 226 are arranged between these disks and act on the respective push rod 209 of the actuating means 201.

The disk 225 comprises notches 229 enabling it to positively receive and lock the first transmission rod 223. The disk 226 is connected to the second transmission rod 224 via eccentric receptions.

The indicator pins 221, the transmission rods 223 and 224 and the actuating rod 228 are each provided with spring means, with the spring means of indicator pins 221 being designed to have a higher elastic force than the spring means of transmission rods 223 and 224.

The operation of the lock-on device of the stilting frame in accordance with the second embodiment shall now be explained.

In order for the lock-on device 10 to function properly, all of the indicator pins 221 in the corner posts 21 must be pushed and thus all of the push rods 209 must be pivoted by the control unit 202 into their operative positions between the driving member 207 of the spiral-jaw clutch 206 and the control element 205 of the switching member 203.

When the stilting frame 20 is picked up by the transhipment equipment 30, the latch bolt 32 engages through the corner casting 24 of the stilting frame 20 in the depression 241 of the actuator 204. The stilting frame 20 is locked to the transhipment equipment 30 through one turn of the latch bolt 32.

Rotation of the actuator 204 by means of the latch bolt 32 effects a linear translation of the control element 205 as it is non-rotatably held in the corner post 21. The rotational direction of the latch bolt 32 of the transhipment equipment 30 is irrelevant as inclined surfaces 242 and 251 slide on each other in either direction. The horizontal surfaces 243 and 252 make sure that the entire lifting movement of the control element 205 is achieved even when the actuator 204 does not complete a rotation by 90 degrees, e.g. as a result of a worn latch bolt 32.

The linear translation of the control element 205 is transmitted to the driving member 207 of the spiral-jaw clutch 206 via the push rod 209. The inclined surfaces 271 and 281 of the spiral-jaw clutch 206 are initially in a relative position in which they overlap by a small amount. The linear translation of the driving member 207 causes the inclined surfaces 271 and 281 to slide on each other. As the driving member 207 is designed to be rotatable only by a slight amount, the switching member 208 is forced to perform a rotating movement. Thus the latch bolt 25 of the stilting frames 20 also rotates and locks the container 40 to the stilting frame 20.

The transhipment equipment 30, the stilting frame 20 and the container 40 are thus coupled to each other and can be moved jointly.

When the latch bolt 32 of the transhipment equipment 30 is again actuated, i.e. disengaged, the connection between the transhipment equipment 30 and the stilting frame 20 is disengaged.

Concurrently, with the rotation of the latch bolt 32 the actuator 204 also rotates. Due to the pressing force of the spring 210, the control element 205 is then pushed upwards and engages the teeth of the actuator 204. Pressure is thus not exerted any more to the driving member 207 by the push rod 209. The driving member 207 is accordingly also linearly translated due to the force of 211 and disengages from the locking engagement with the switching member 208. The position of the latch bolt 25 of the stilting frame 20 is not modified hereby, as merely the vertical surfaces 272 and 282 slide on each other.

Following the disengagement of vertical surfaces 272 and 282, the driving member 207 slightly rotates such the inclined surfaces 271 and 281 overlap by a small amount. This is achieved by the fact that the driving member 207 is formed to include an oblong recess 273, with the pin 294 engaging in the round portion 293 of the push rod 209. Upon the rising movement of the driving member 207, it moves by gravity as far as permitted by the pin 294 in the oblong recess 273. As the oblong recess 273 is oriented at an angle with the vertical, a slight rotation of the driving member 207 on the push rod 209 is thus performed. The driving member 207 and the switching member 208 are thus disengaged; the inclined portions 271 and 281 are, however, overlapped in the process such as to slide on each other upon renewed linear translation towards each other.

In this position, the container 40 remains coupled to the stilting frame 20, with the latter being uncoupled from the transhipment equipment 30. As a result, the container 40 and the stilting frame 20 can be jointly picked up e.g. by another transhipment equipment 30.

When the actuator 204 is again actuated by the latch bolt 32 of a transhipment equipment 30, this in turn causes a rotation of the actuator 204. This results in a renewed linear translation of the control element 205 which is then transmitted to the driving member 207 via the push rod 209. The slightly overlapping inclined surfaces 271 and 281 of the driving member 207 and of the switching member 208 slide on each other to cause a rotation of the switching member 208. Hereby, the driving member 207 is pushed downward into the teeth of the switching member 208 while the pin 294 situated in the oblong recess 273 slides against its lower stop.

Concurrently, with the rotation of the switching member 208, the latch bolt 25 of the stilting frame 20 also rotates. Hereby, the container 40 is unlocked from the stilting frame 20.

In this position the stilting frame 20 is coupled to the transhipment equipment 30 whereas the container 40 is not locked to the stilting frame 20. Thus, it is possible to lift the stilting frame 20 off the container 40 and set it down, or place it on another container 40.

One more actuation of the latch bolt 32 of the transhipment equipment 30 in turn causes disengagement of transhipment equipment 30 and stilting frame 20. Hereby, the actuator 204 is in turn rotated such that the control element 205 is enabled to engage the teeth of the actuator 204. The control element 205 in turn is pushed upwardly by the force of the spring 210, whereby the pressure on the push rod 209 and thus on the driving member 207 is cancelled. The driving member 207 is then also lifted off in an upwardly direction owing to the force of the spring 211. The teeth of the driving member 207 and of the switching member 208 disengage, and the sliding motion of the pin 294 in the oblong recess 273 again causes slight overlapping between the inclined surfaces 271 and 281. The switching member 208 and thus the latch bolt 25 of the stilting frame 20 are not actuated.

In this position the connection between the container 40 and the stilting frame 20 as well as the connection between the transhipment equipment 30 and the stilting frame 20 are disengaged. The latter is thus deposited e.g. at its storage location.

The mechanism of the lock-on device according to the invention thus permits four positions which enable fully automatic operation of the stilting frame.

The operation of the control unit 202 shall now be explained by reference to FIGS. 10 to 18.

Figure 10:
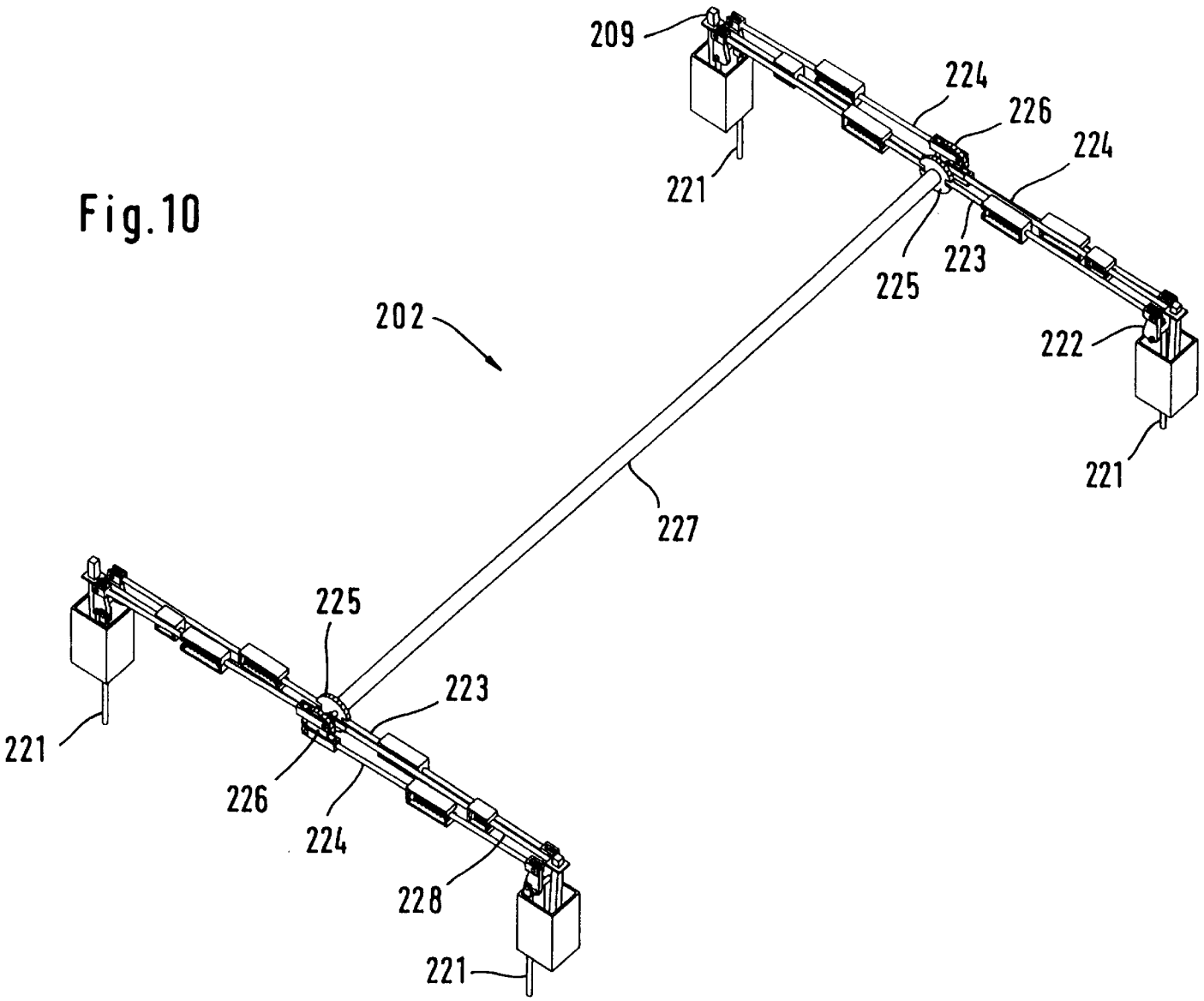
FIG. 10 shows a control unit of the second embodiment of the lock-on device, with the stilting frame not resting on a container.

FIG. 10 represents a position of the control unit 202 wherein all of the push rods 209 are pivoted such as not to be susceptible to actuation by the linear translation of the control element 205. In the represented case, none of the indicator pins 221 is pushed.

Figure 11:
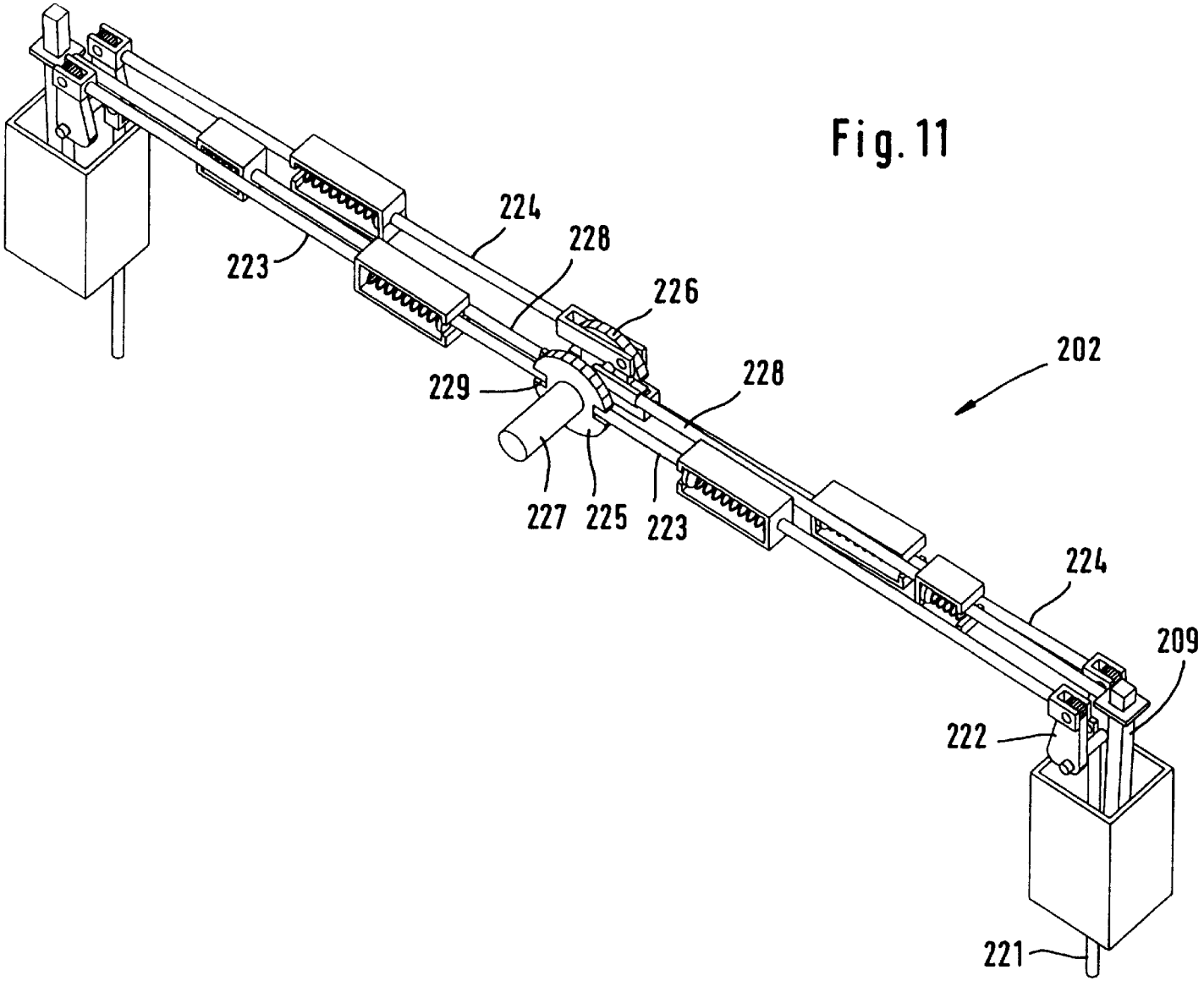
FIG. 11 shows a detail of the control unit according to FIG. 10.
Figure 12:
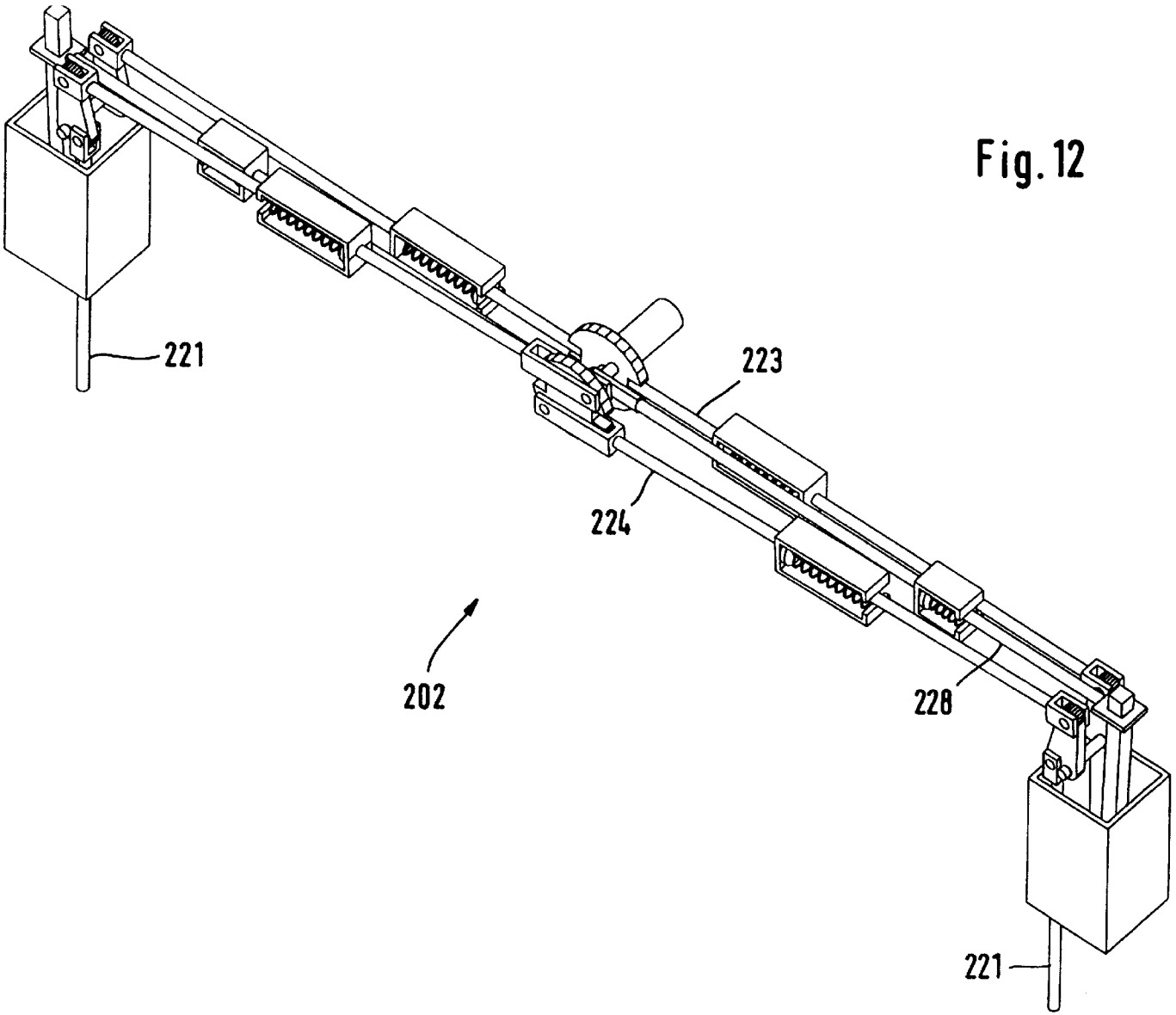
FIG. 12 shows another detail of the control unit according to FIG. 10.

As is shown in more detail in FIGS. 11 and 12, the first transmission rod 223 is engaged with the notches 229 of the disk 225. This positive connection prevents rotation of the disk 225. In this position, the eccentric reception for the actuating rod 228 on the disk 225 is positioned such that the push rods 209 are pushed outwardly.

Figure 13:
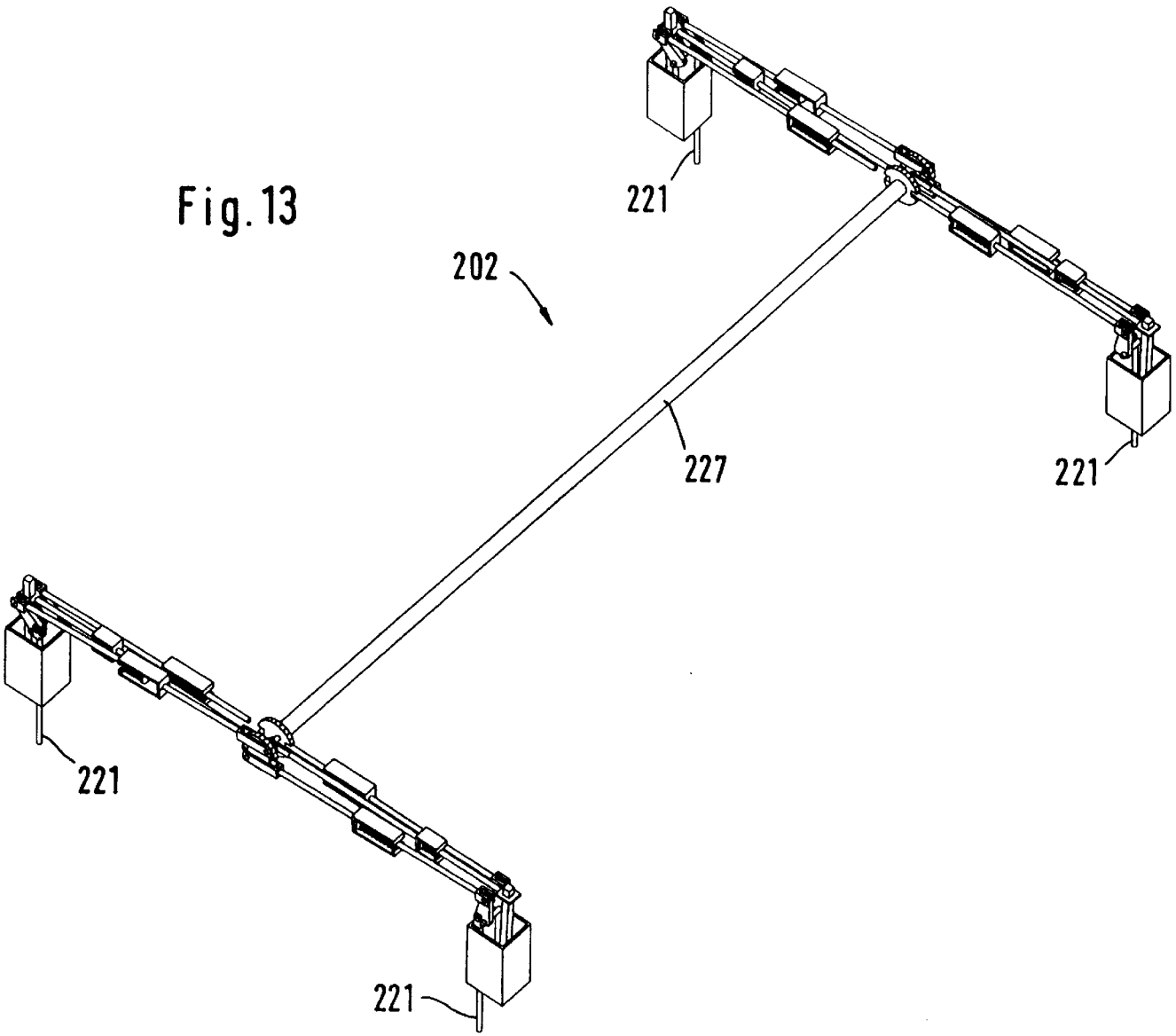
FIG. 13 shows the control unit in a representation corresponding to the one of FIG. 10 in a position wherein the stilting frame only partly rests on the container.
Figure 14:
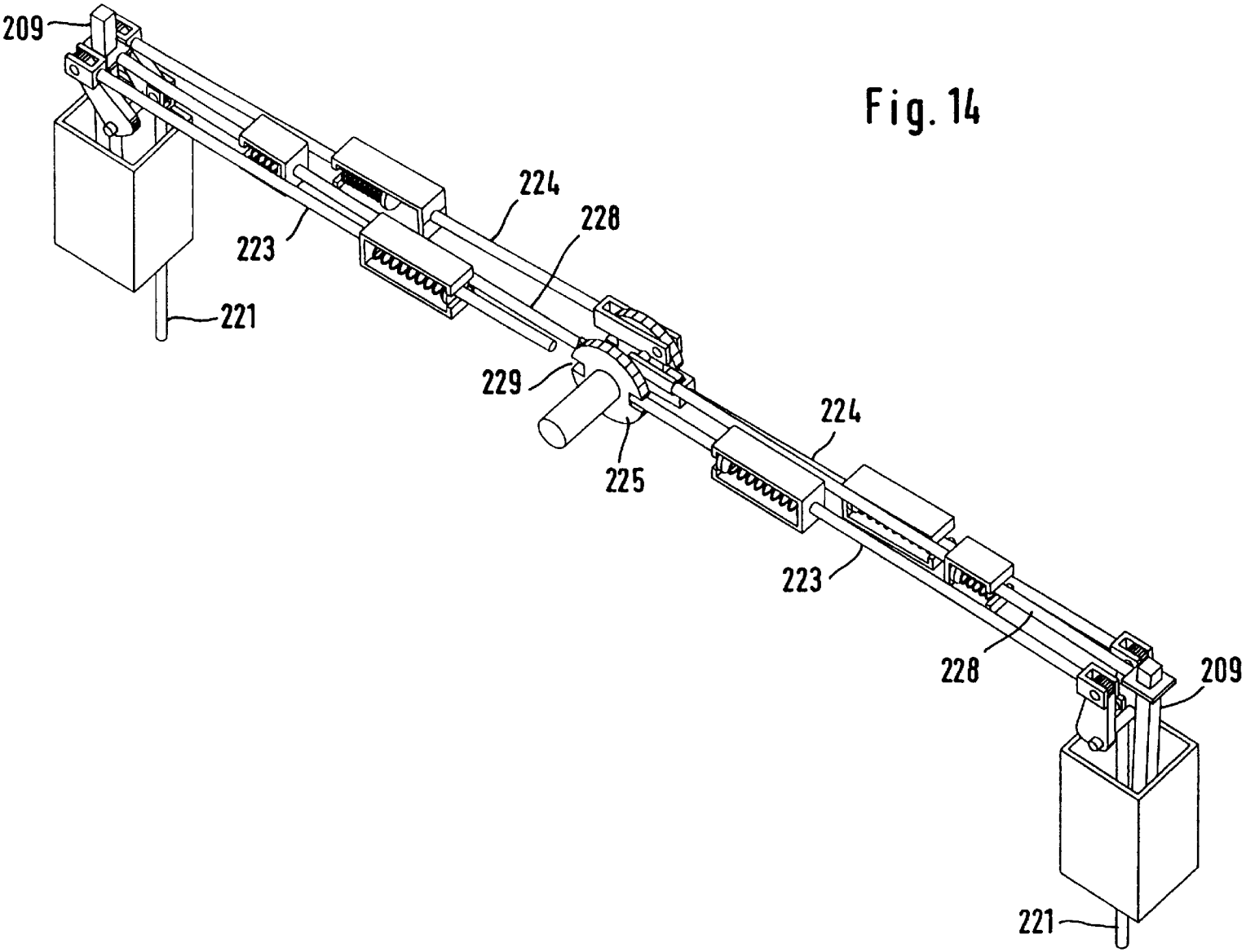
FIG. 14 shows another detail of the control unit according to FIG. 13.
Figure 15:
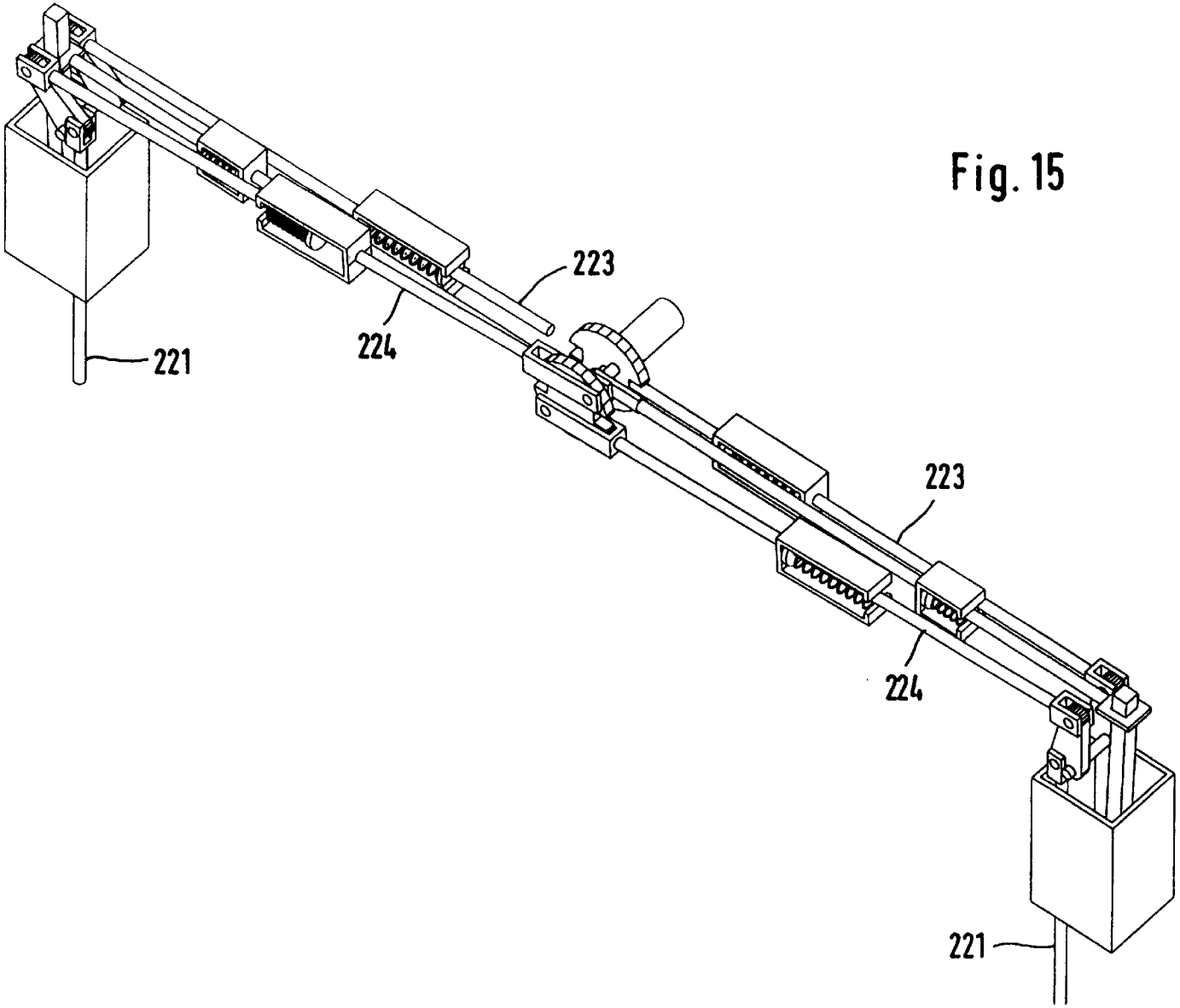
FIG. 15 shows another detail of the control unit according to FIG. 13.

If single indicator pins 221 are pushed in accordance with the representations of FIGS. 13, 14 and 15, then the respective first transmission rods 223 are disengaged from the notches 229 of the disks 225. As, however, not all of the first transmission rods 223 lose positive engagement with the disk 225, the latter is furthermore prevented from rotation.

Thus, the actuating rods 228 are not subjected to an actuating force by the disk 225 while push rods 209 remain disengaged.

This is the case when the stilting frame 20 is not placed correctly on the container 40, or if one or several latch bolts 25 of the stilting frame 20 are not engaged in the slot 43 of the respective corner casting 42 of the container 40.

If, however, a latch bolt 25 of the stilting frame 20 at the beginning of the lifting process disengages from a corner casting 42 of the container 40, then the lever mechanism 222 is actuated and the first transmission rod 223 pushes against the disk 225 with the force of the spring means. As the latter is rotated in the represented case, the first transmission rod 223 initially does not enter into engagement with the notch 229 of the disk 225. The lever mechanism 222 does, however, act on the second transmission rod 224 to thereby bring about a rotation of coupled disks 225 and 226.

Thus, all four push rods 209 are disengaged and the application of pressure to the spiral-jaw clutch 206 is cancelled.

In the specified cases in which not all indicator pins 221 are pushed, the container 40 is thus kept from being lifted. A hazard to the cargo or to close-by personnel is thus excluded.

Figure 16:
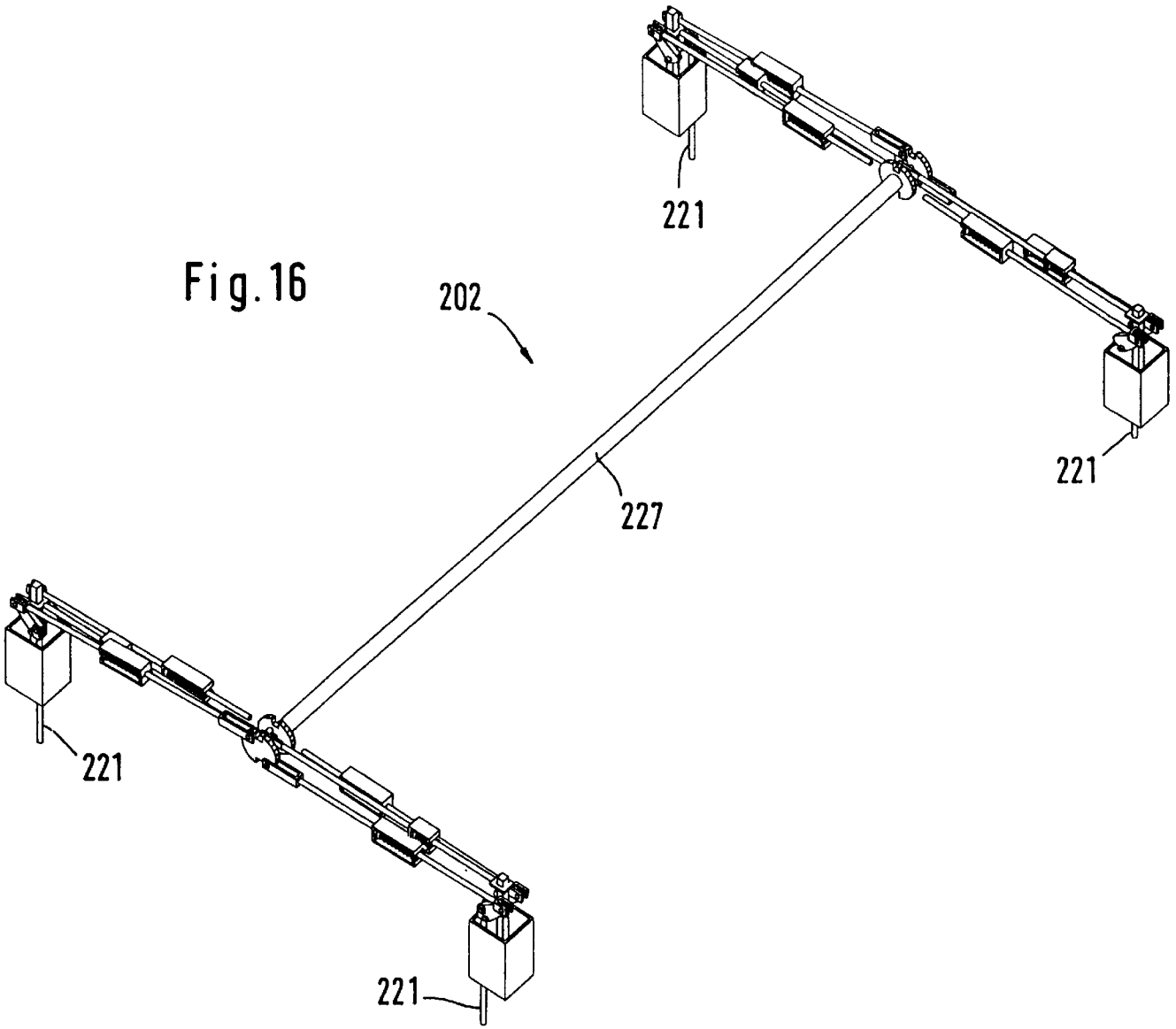
FIG. 16 shows the control unit in a representation corresponding to the one of FIG. 10 in a position wherein the stilting frame correctly rests on the container.
Figure 17:
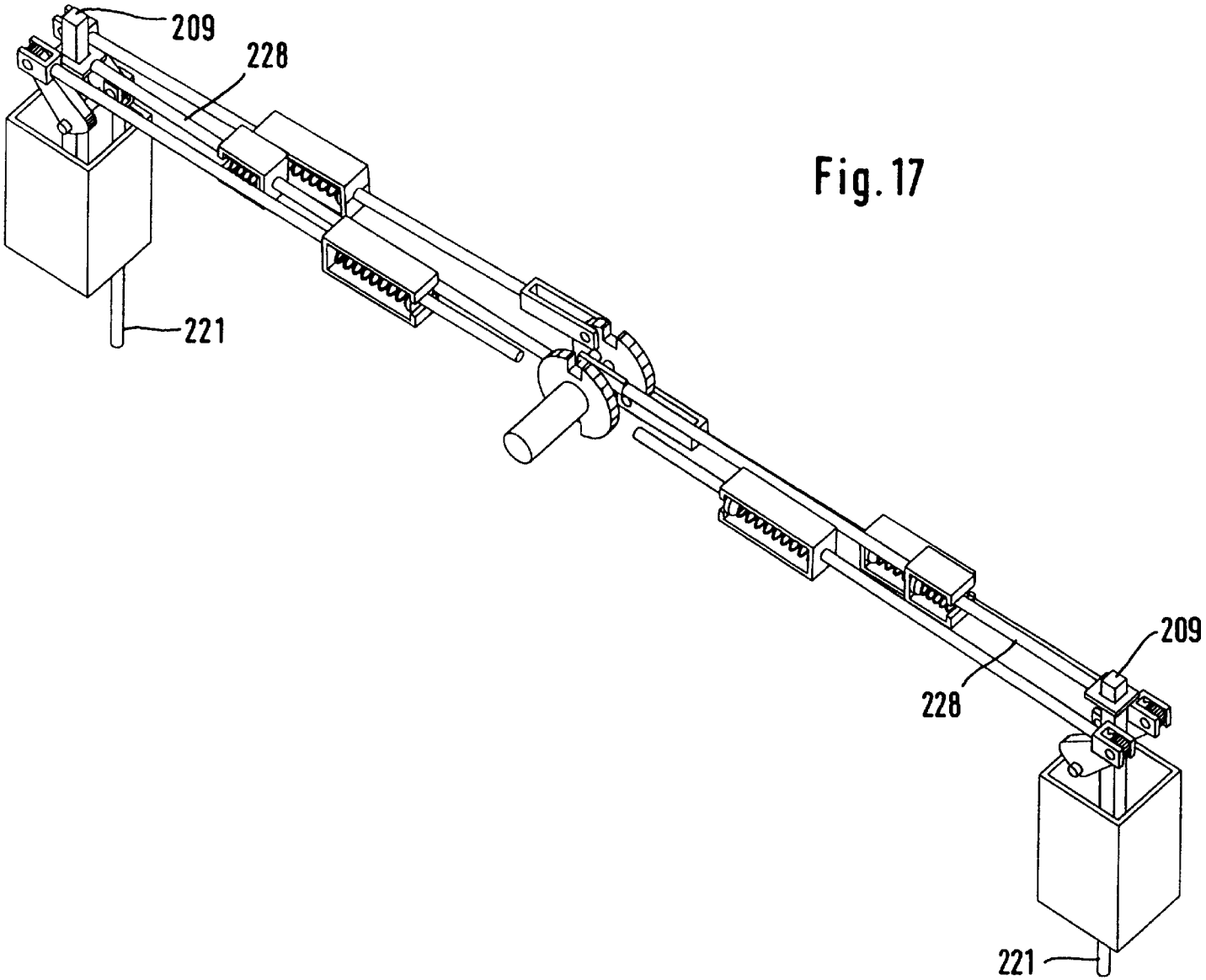
FIG. 17 shows a detail of the control unit according to FIG. 16.
Figure 18:
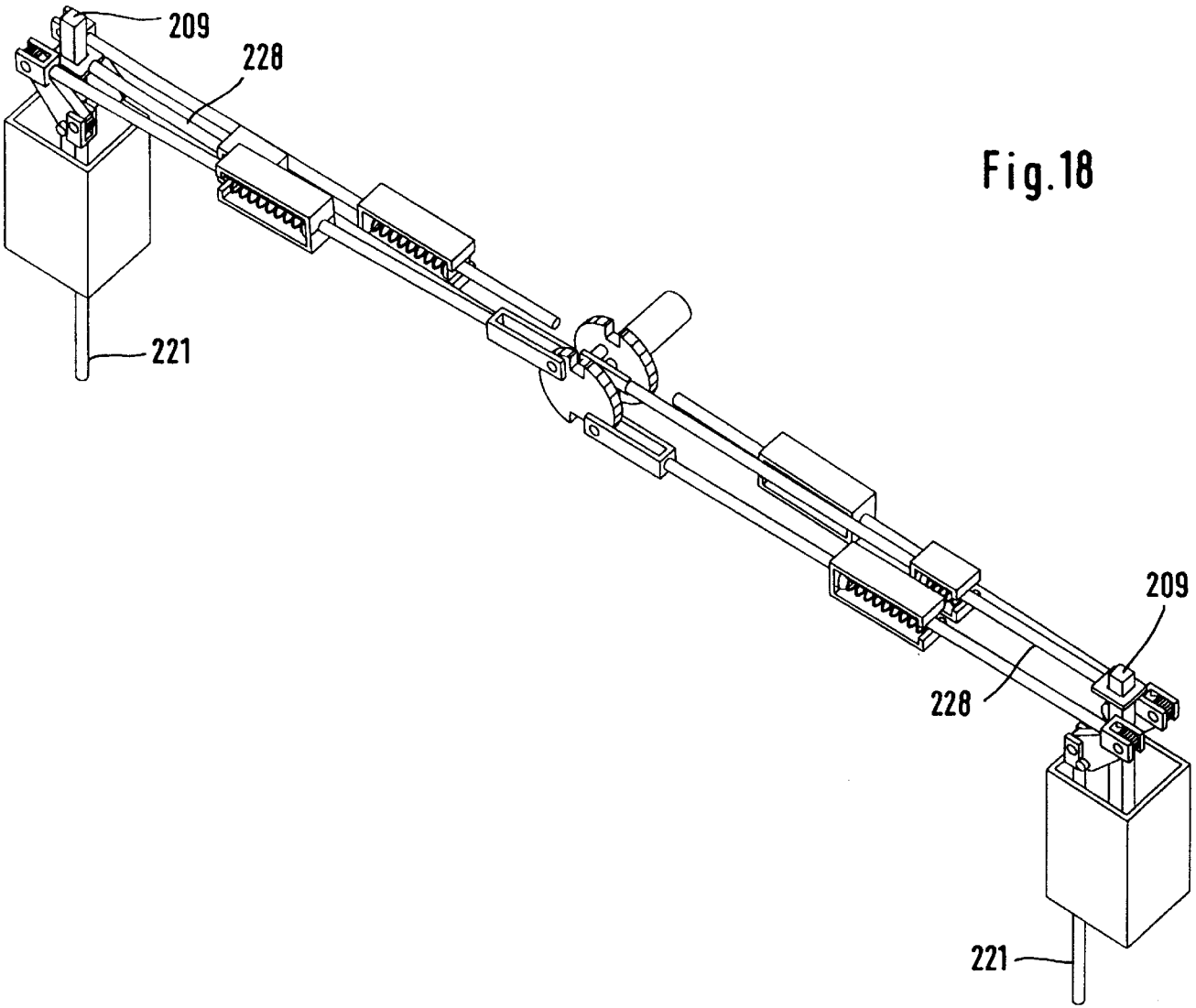
FIG. 18 shows another detail of the control unit according to FIG. 13.

When all of the indicator pins 221 are pushed, as can be seen in FIGS. 16, 17 and 18, then the push rods 209 are pivoted into their operative positions via the actuating rods 228, and the desired position of the lock-on device 10 can be set. In this situation, the operator of the transhipment equipment 30 can establish the desired coupling between the transhipment equipment 30, the stilting frame 20 and the container 40.

An indicating apparatus on the stilting frame 20, e.g. of the mechanical type (not represented in the drawing), informs the operator of the transhipment equipment 30 about the current position of the lock-on device 10.

Figure 19:
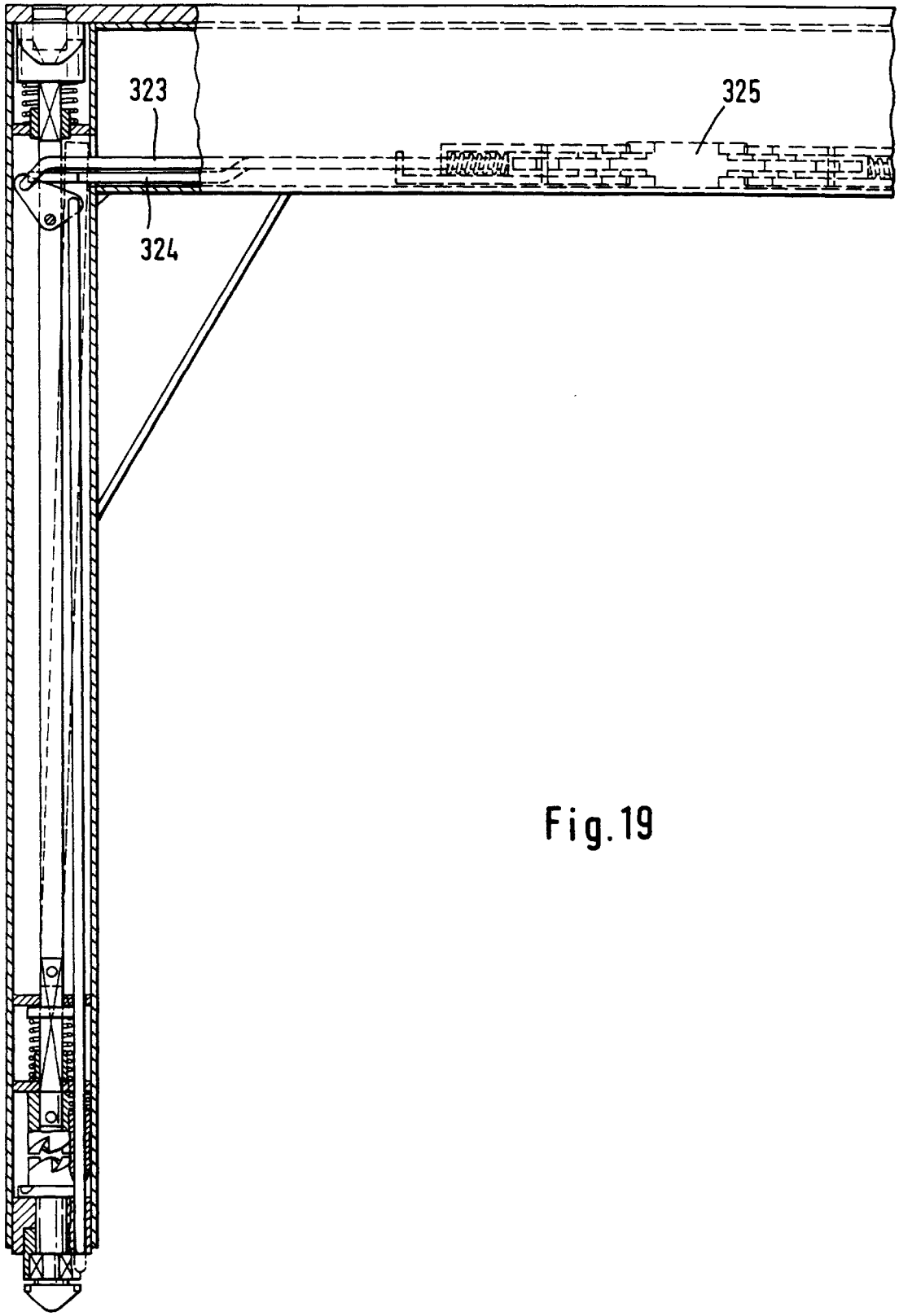
FIG. 19 is a sectional view of a lock-on device with another embodiment of the control unit.
Figure 20:
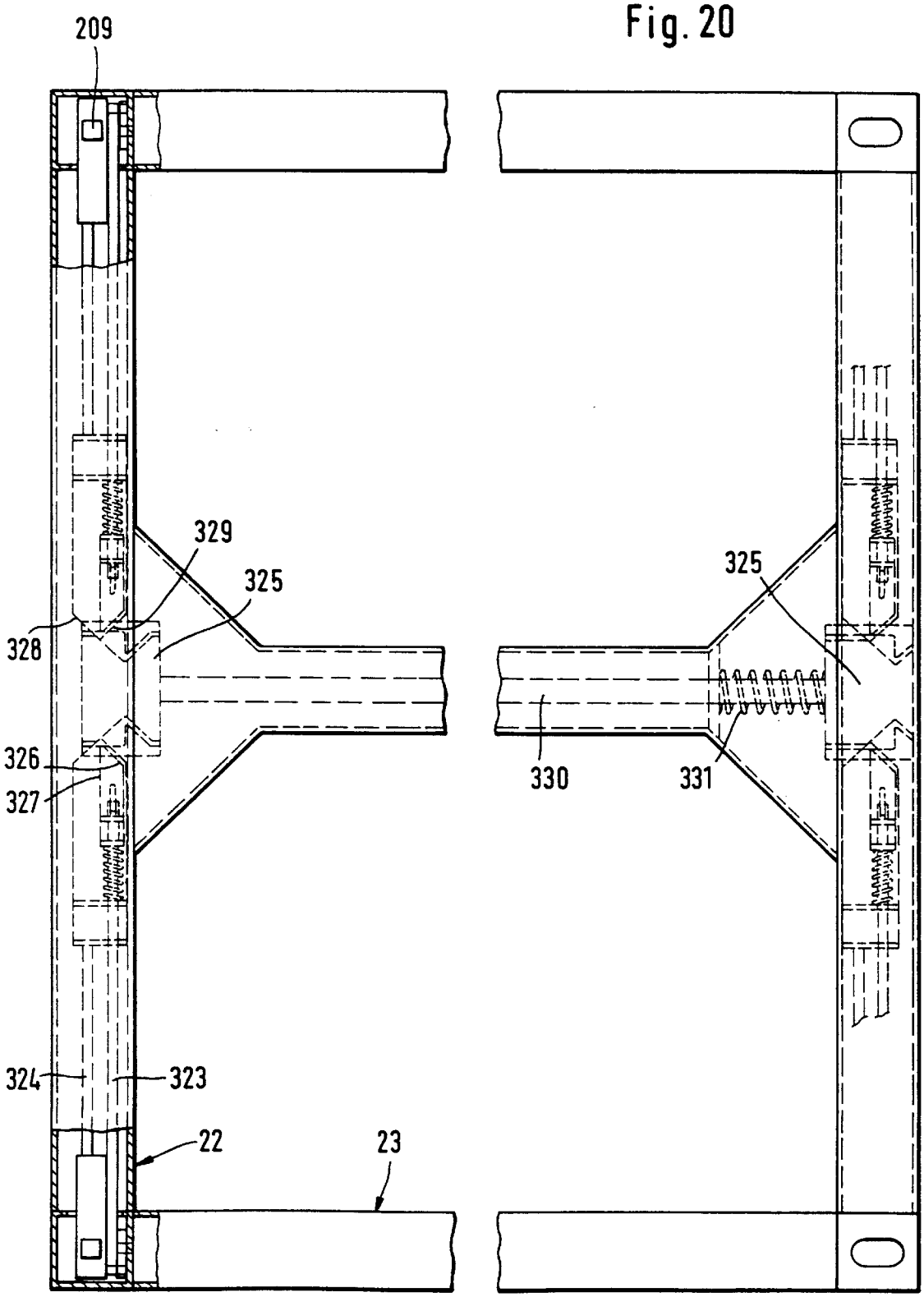
FIG. 20 is a plan view of the control unit according to FIG. 19.

FIGS. 19 and 20 show another embodiment of the control unit. Apart from the indicator pin 221 and the lever mechanism 222 already described, it provides a first slide bar 323 and a second slide bar 324. These influence a switching member 325 having a central position in the transverse members 22 of the stilting frame 20.

The first slide bar 323 includes an inclined surface 326 and a vertical surface 327. The switching member 325 is provided with complementary surfaces. The second slide bar 324 comprises at its front end two inclined surfaces 328 and 329 which also co-operate with complementary surfaces on the switching member 325. The second slide bar 324 is directly connected to the push rods 209.

The switching members 325 at the respective longitudinal ends of the stilting frame 20 are connected via a coupling bar 330. A spring 331 ensures a positioning of the switching members 325 in their home position such as not to be in engagement with the slide bars 323 and 324.

In the position represented in FIG. 20, all of the push rods 209 are engaged, and the lock-on device 10 according to the invention can be actuated.

If, however, not all of the indicator pins 221 are pushed, the inclined surface 328 of the second slide bar 324 will slide on the complementary surface of the switching member 325 and pull it in a transverse direction against the force of spring 331. The first slide bar 323 finally enters into engagement with the complementary recess in the switching member 325 to lock it. The lock-on device 10 cannot be actuated in this position as the second slide bar 324 was pulled inwardly by the lever mechanism 222 and the push rod 209 was pivoted from its operative position.

If, however, all of the indicator pins 221 are pushed, then the first slide bar 323 is disengaged from the switching member 325 by the lever mechanism 222. These are then displaced laterally by the force of spring 331, such that the inclined surfaces 328 and 329 of the second slide bar 324 slide on the complementary surfaces on the switching member 325 and the push rods 209 are pivoted into their operative position.

The lock-on device 10 of the stilting frame shall now be explained by referring to another embodiment. Merely those elements in which it differs from the previously described embodiments have been provided with new reference symbols.

Figure 21:
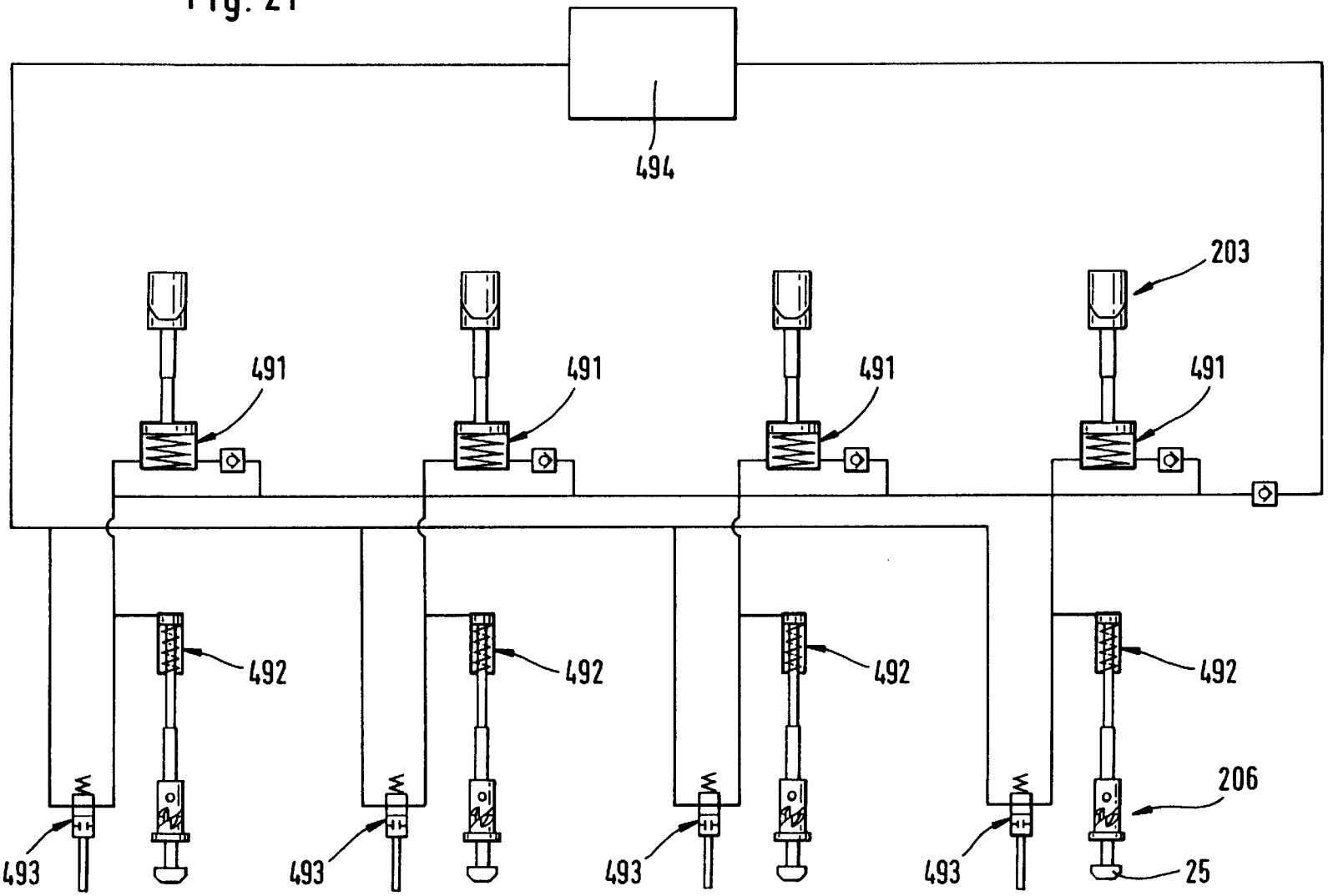
FIG. 21 shows another embodiment of the lock-on device with hydraulic actuation of the control unit.

In accordance with the representation of FIG. 21, the pressing rod is in this embodiment replaced by two hydraulic cylinders 491 and 492. When the indicator pins 221 are pushed, the indicator pin valves 493 close, and upon actuation of the switching members 203 by the latch bolt 32 of the transhipment equipment 30, pressure is applied to the upper cylinder 491, which is transmitted to the lower cylinder 492 and causes actuation of the spiral-jaw clutch 206.

If one or more of the indicator pins 221 are not pushed, then the pressure exerted by the upper cylinder 491 is relieved through the currently open indicator pin valve(s) 493 into a tank 494, and the spiral-jaw clutch 206 is not actuated.

In order to achieve effective application of pressure, the upper pressure cylinder 491 is designed to have a greater diameter than the lower hydraulic cylinder 492. The springs of the lower hydraulic cylinder 492 are designed to be stronger than the line resistance generated when the entire flow of oil is relieved only through one indicator pin valve 493. Even in the most unfavorable case the spiral-jaw clutch 206 is thus not actuated.

The problem of the line resistance might also be solved by the lower hydraulic cylinder 492 being provided with a pressure control valve and a parallel back pressure valve.

In accordance with another aspect of the present invention, the stilting frame 20 comprises a lock-on device 10 which is actuated by mechanical and hydraulic means.

In accordance with the representations of FIGS. 22 to 34 the lock-on device 10 of the invention comprises switching members 501A and 501B constituting those two switching members of the four switching members 501 of the stilting frame 20 which act on the lock-on device 10. The other two switching members 501 are also actuated by the latch bolts of the transhipment equipment, but do not have any effect on the lock-on device 10.

The first switching member 501A is connected to a cam plate 504 forming part of a mechanical switch 503 through a chain 505. The cam plate 504 is designed such as to effect, starting out from a neutral position, a translation of a pushing member 506 coupled thereto when subjected to a rotating movement.

The pushing member 506 in turn includes a pivotable portion 507 and an engagement member or claw 508. The pivotable portion 507 can be engaged by means of a hydraulic switch 502 to actuate an actuator 510. In the process, the claw 508 engages one of the actuating elements 509, e.g. pins, which are arranged on the actuator 510 in a position radially offset from its center. Hereby, the translatory movement of the pushing member 506 is transformed into a rotating movement of the actuator 510.

The actuator 510 is connected to a latch bolt 25 of the stilting frame 20 by means of a chain 511 in such a way that a rotating movement of the actuator 510 directly causes a rotating movement of the latch bolt 25.

The latch bolt 25 coupled with the actuator 510 is in turn coupled to the further latch bolts 25 of the stilting frame by means of a chain 512. This results in synchronous actuation of the latch bolts 25 of the stilting frame.

The second switching member 501B is connected to a hydraulic cylinder 514 in such a way that a rotating movement of the switching member 501B, owing to the rotation of a latch bolt 32 of the transhipment equipment 30, results in pressure build-up in a hydraulic system 515.

The hydraulic system 515 comprises a valve assembly 516, a pressure line 517, a control line 518 and a tank line 519. The lines 517, 518 and 519 are connected to indicator valves 520 having in this embodiment the form of 3/2-way directional valves. These are coupled to indicator pins 513 provided at each corner post 21 of the stilting frame 20.

The control line 518 and the tank line 519 are furthermore connected to the hydraulic switch 502 such that the latter is activated when all of the indicator pins 513 are pushed. In this case the indicator valves 520 at the indicator pins 513 bring about application of pressure in the control line 518. This application of pressure is, however, only established if all of the indicator valves 520 are actuated, otherwise the control line 518 is relieved via tank line 519.

The valve assembly 516 comprises a changeover valve assembly 521, a reservoir 522 and a relief valve 523. At each piston movement of the hydraulic cylinder 514 a pressure is generated which is alternatingly applied to either side of the changeover valve assembly 521 and stored in the reservoir 522. As soon as the generated pressure exceeds a predetermined threshold in the reservoir 522, the relief valve 523 responds and initiates relief to the tank.

The operation of the lock-on device 10 shall now be explained in detail by referring to FIGS. 22 to 34.

Figure 22:
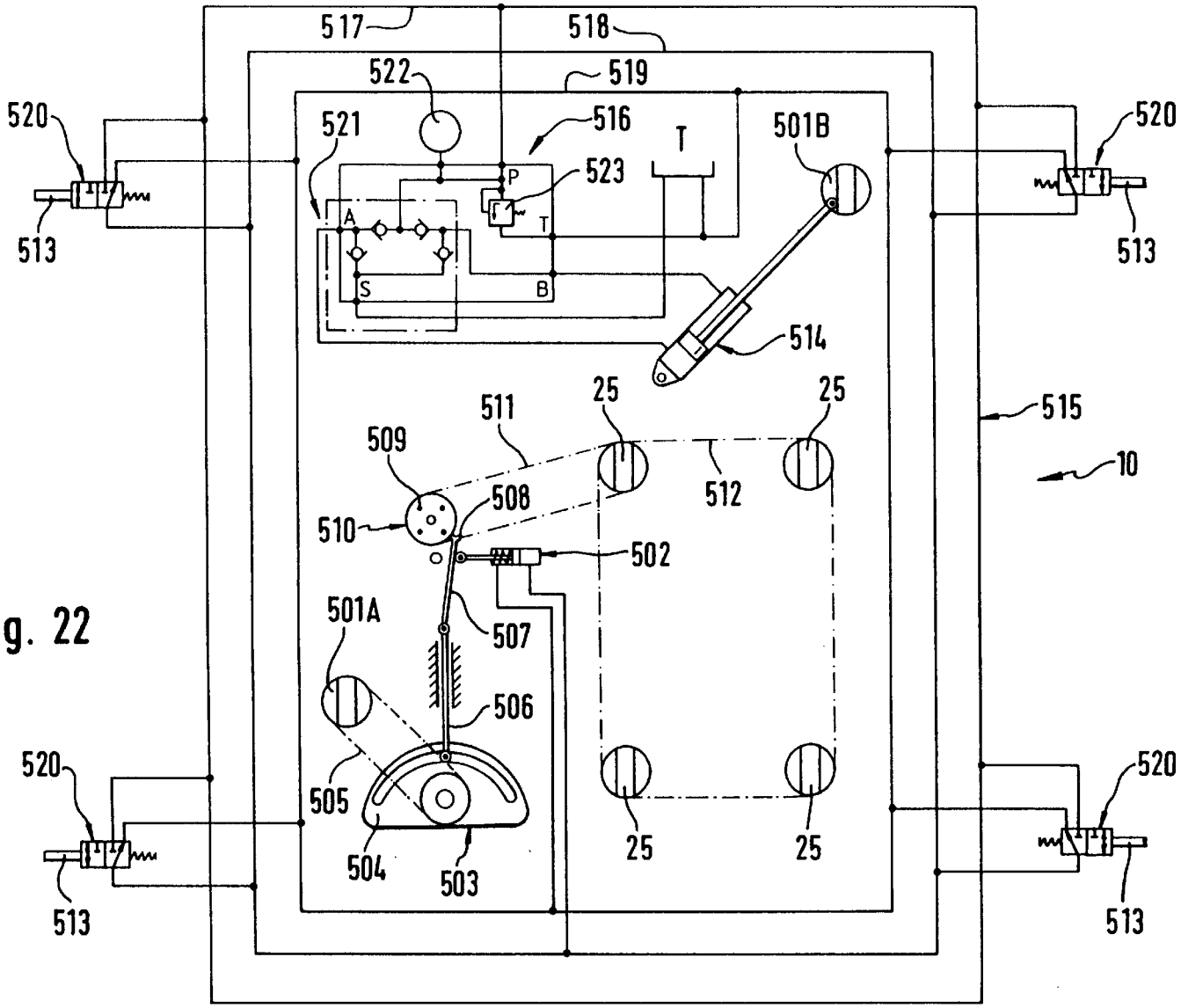
FIGS. 22 to 34 are schematic representations of the lock-on device of the stilting frame according to the invention in successive positions.

In the representation according to FIG. 22, the stilting frame 20 is set down and connected neither to a container 40 nor a transhipment equipment 30. Accordingly the latch bolts 25 of the stilting frame 20 are disengaged while the switching members 501 of the stilting frame are in the unlocked position.

Figure 23:
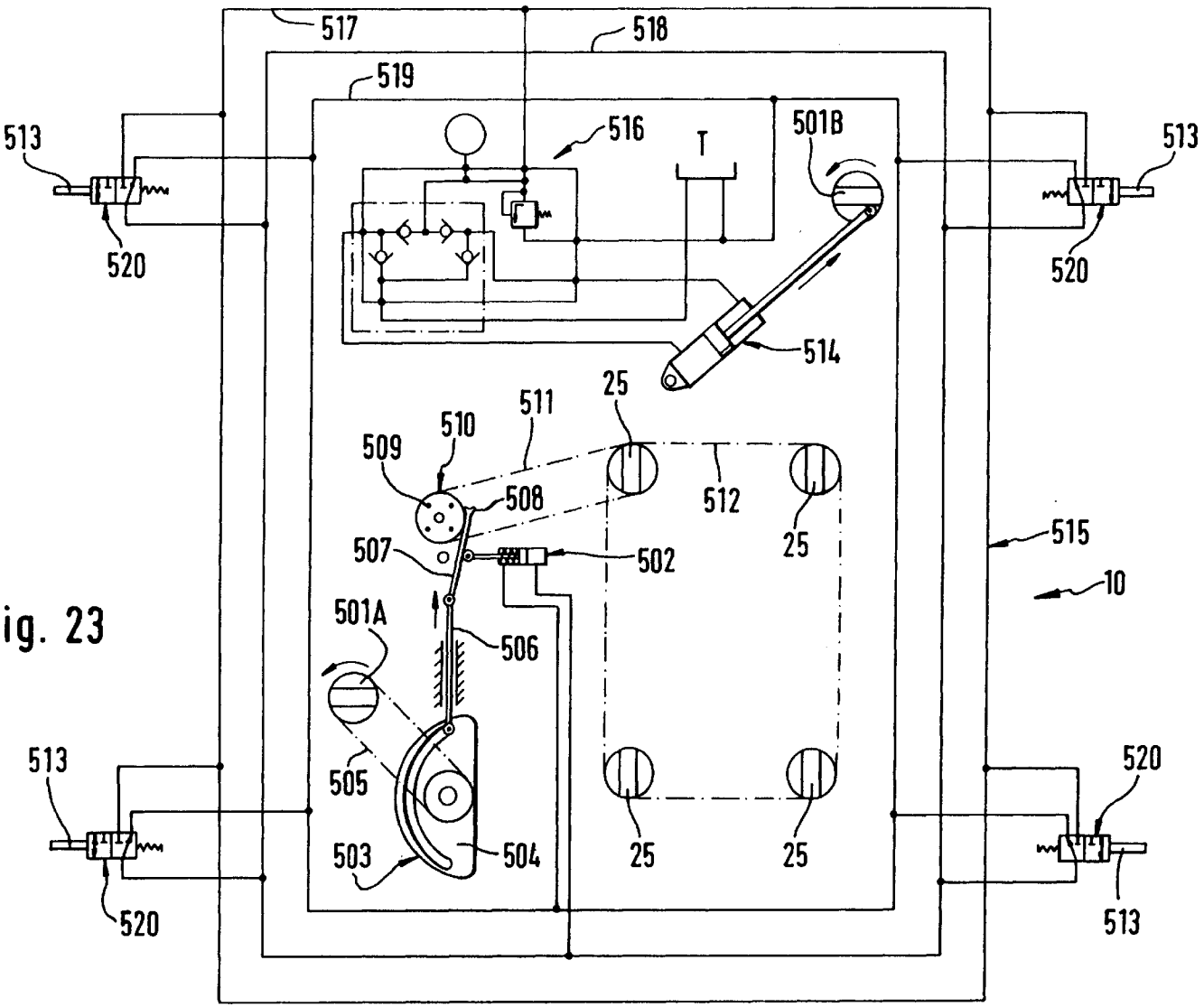

When the stilting frame 20 is picked up by a transhipment equipment 30 or the like, it is placed on the stilting frame 20, and the latch bolts 32 of the transhipment equipment 30 are actuated such that the switching members 501 perform a rotating movement e.g. in the direction represented in FIG. 23. At the same time the cam plate 504 is rotated and a translatory movement onto the pushing member 506 is performed. Because the indicator pins 513 are not pushed, however, the hydraulic switch 502 is not activated and the pivotable portion 507 of the pushing member 506 does not engage an actuating element 509 of the actuator 510. Therefore, the actuator 510 does not perform a rotating movement, and the latch bolts 25 of the stilting frame 20 do not change their positions.

The rotating movement of the switching member 501 B concurrently results in generation of pressure by means of the hydraulic cylinder 514.

Figure 24:
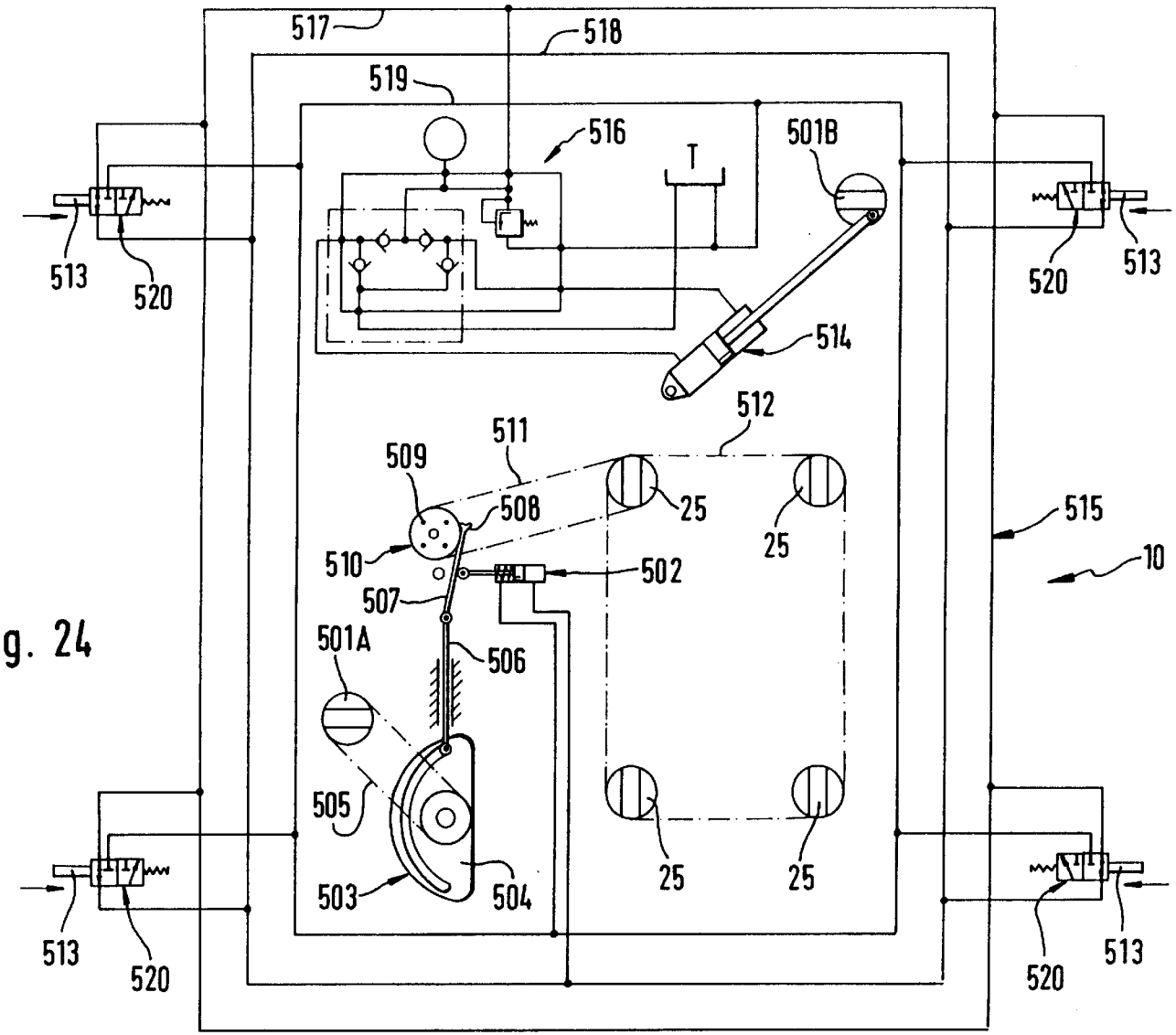
Figure 25:
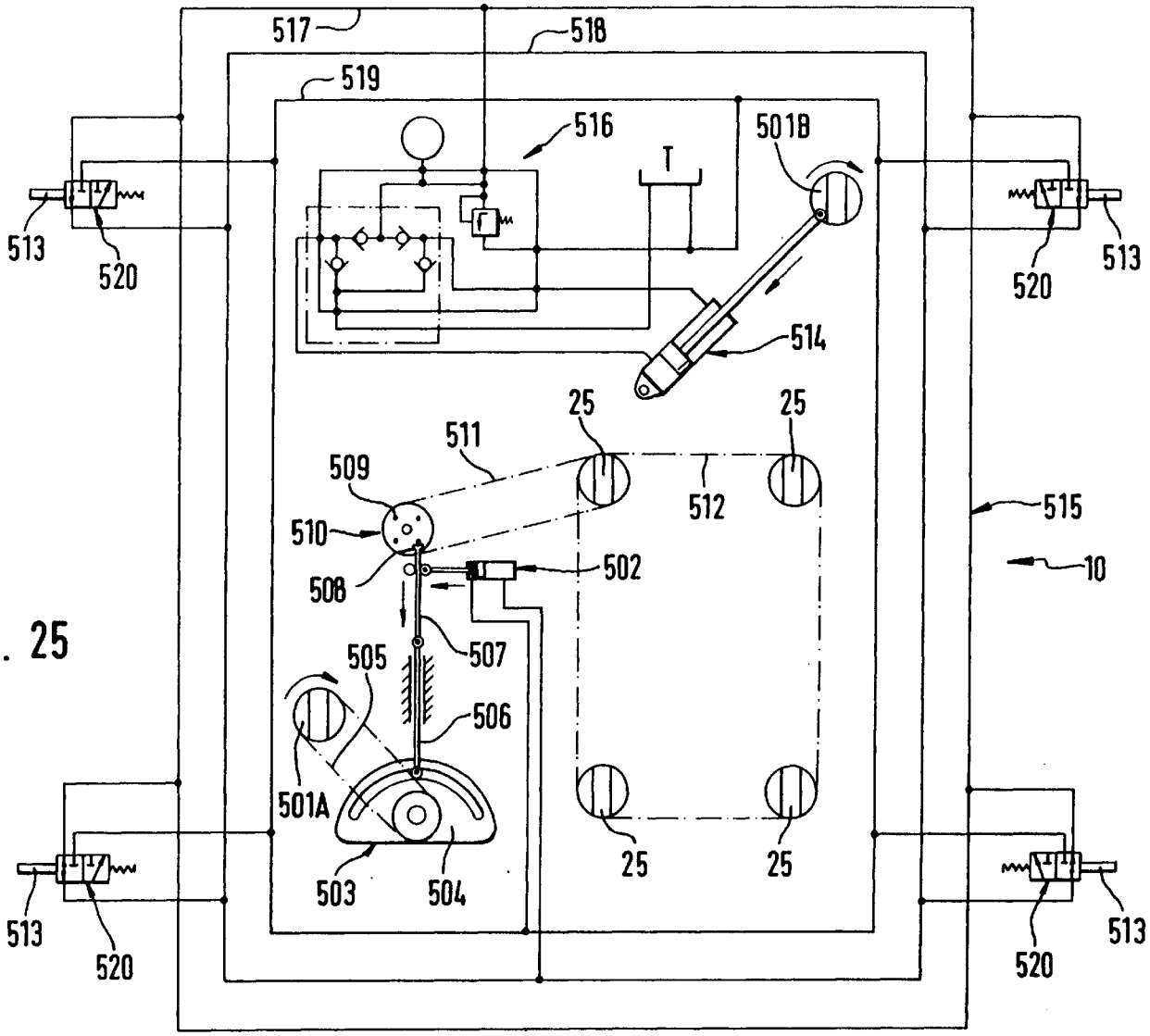
Figure 26:
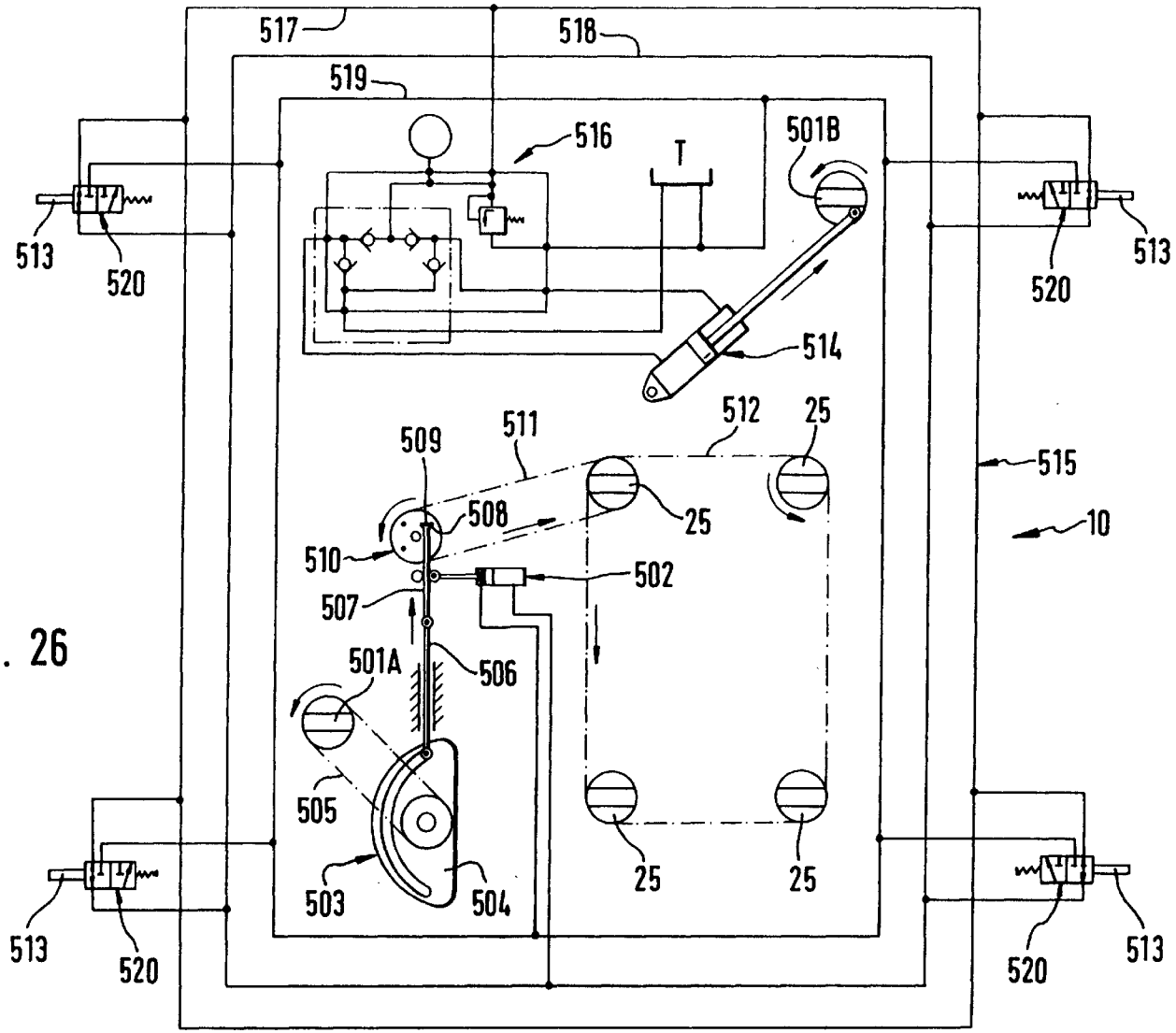
Figure 27:
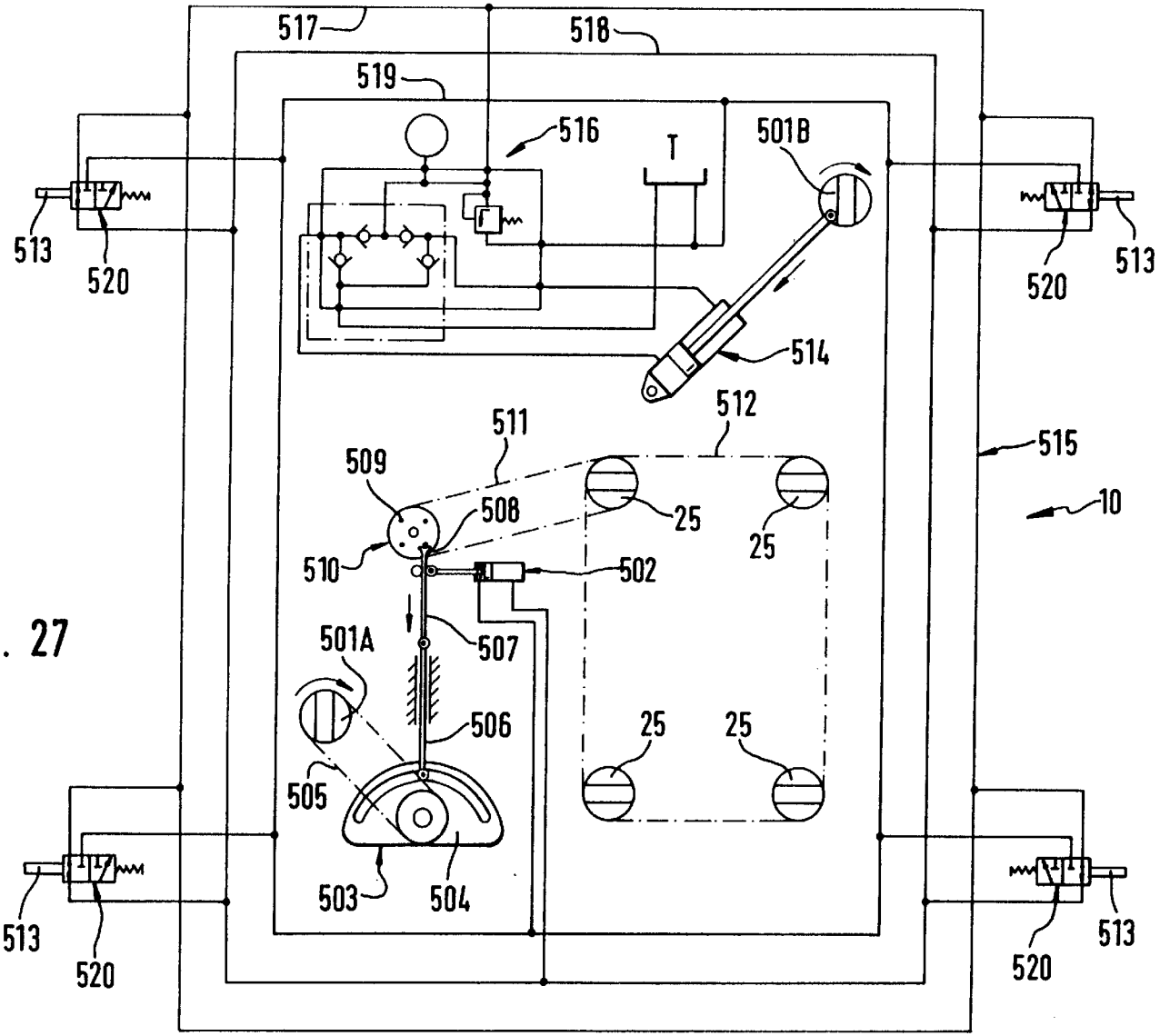

When the stilting frame 20 is placed on a container 40, the indicator pins 513 are pushed and the indicator valves 520 are activated in accordance with the representation of FIG. 24. In accordance with the representation of FIG. 25 the latch bolts 32 of the transhipment equipment 30 are unlocked, whereby the switching members 501 are reset. As a result they reset the mechanical switch 503 and generation of a pressure by means of the hydraulic cylinder 514, which serves to activate the hydraulic switch 502.

This hydraulic switch causes the pivotable portion 507 of the pushing member 506 to be engaged such that, upon a repeated locking movement of the latch bolts 32 of the transhipment equipment 30 through the translatory movement of the pushing member 506, it acts on the actuating elements 509 and causes a rotation of the actuator 510. Jointly with the latter the latch bolts 25 of the transhipment equipment 20, being coupled to it, rotate, whereby locking of the transhipment equipment 20 on the container 40 is achieved. In this position the transhipment equipment 30, the stilting frame 20 and the container 40 are joined to each other (cf. FIG. 26).

When the container 40 is set down jointly with the stilting frame 20 coupled to it, then only the latch bolts 32 of the transhipment equipment 30 are returned into the unlocked position and thereby the connection between the transhipment equipment 30 and the stilting frame 20 is disengaged. The translatory movement of the pushing member 506 is performed such that a rotating movement of the actuator 510 is not effected and that the latch bolts 25 of the stilting frame 20 remain engaged with the container 40 (cf. FIG. 27).

Figure 28:
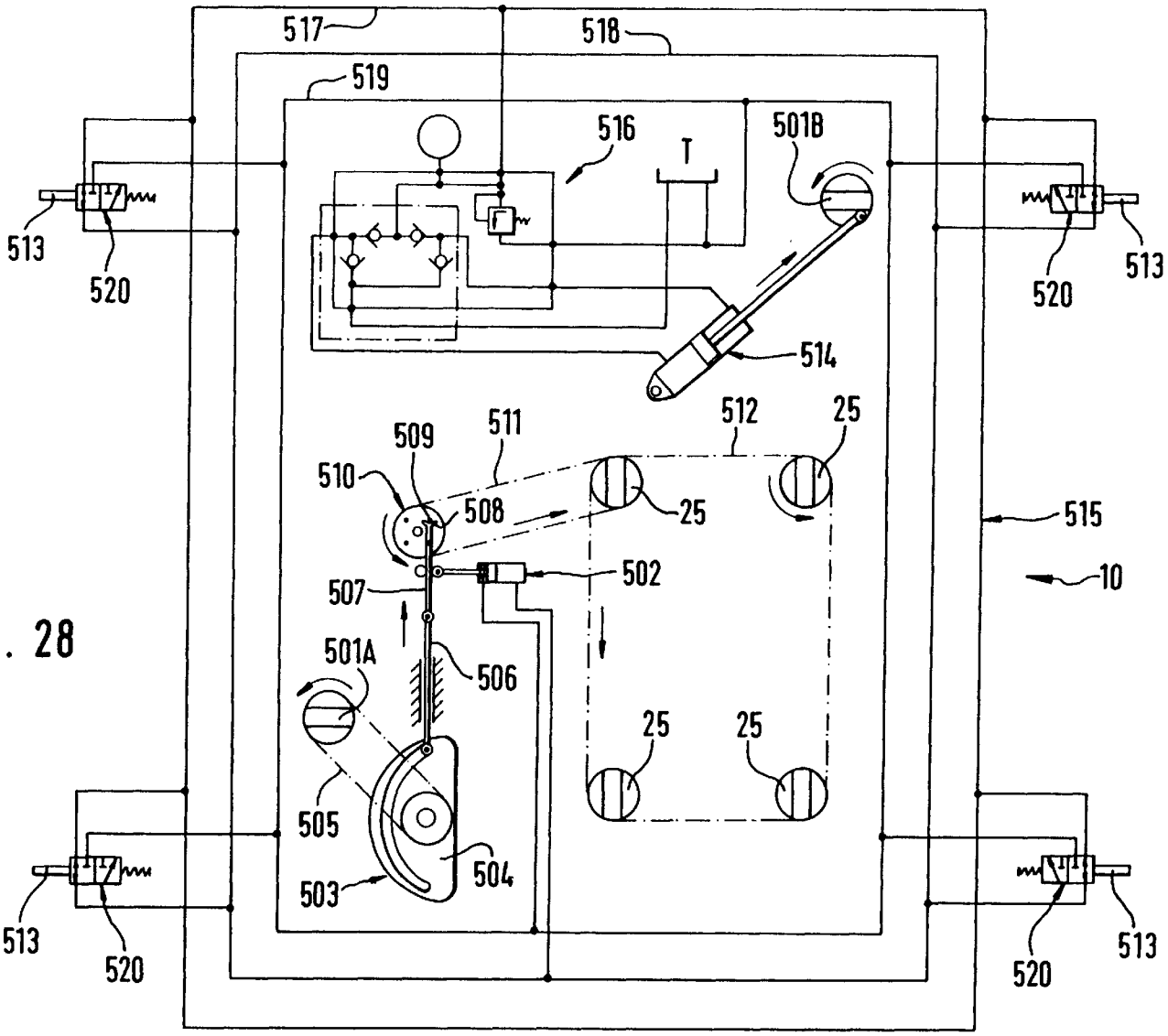
Figure 29:
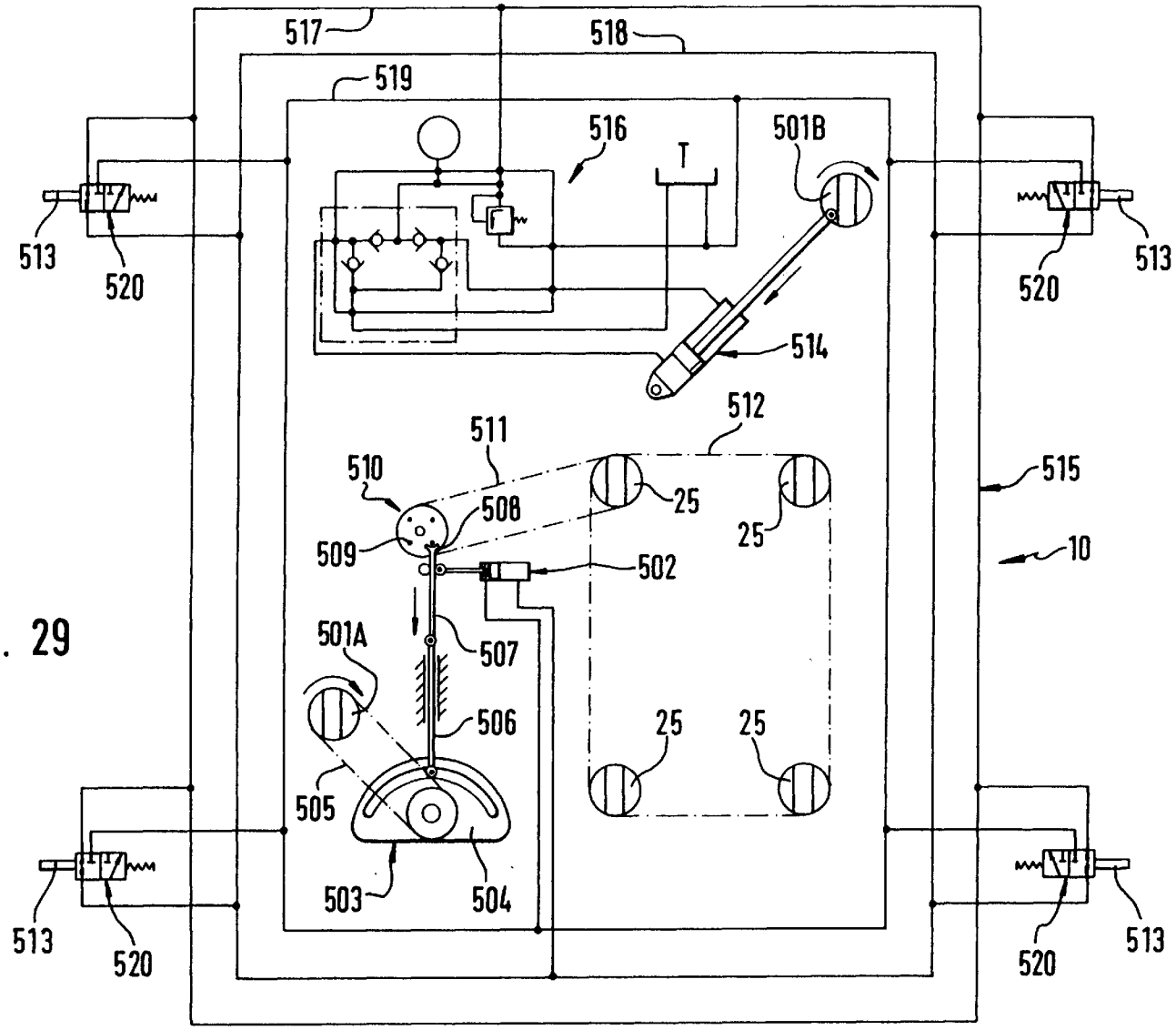
Figure 30:
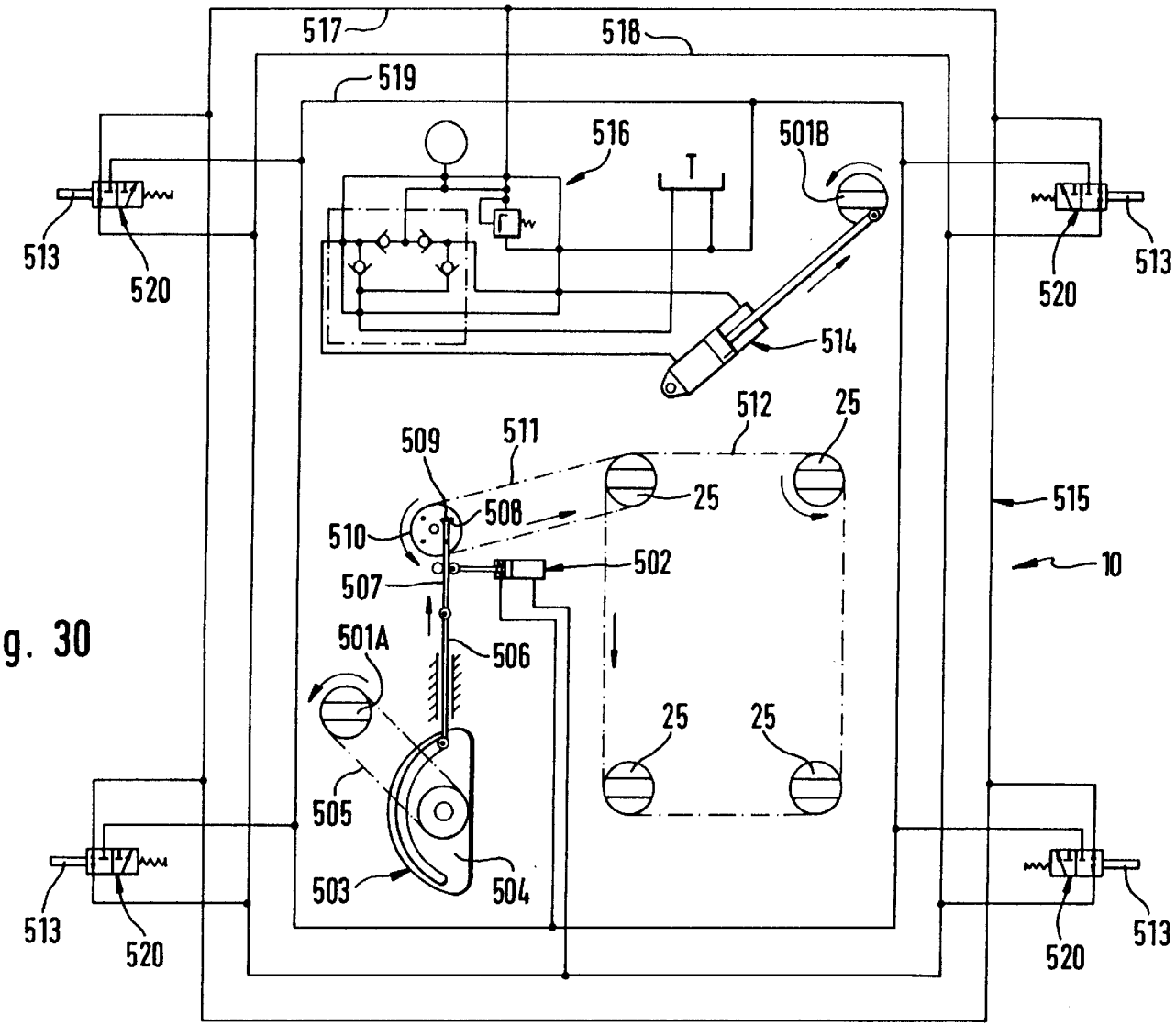
Figure 31:
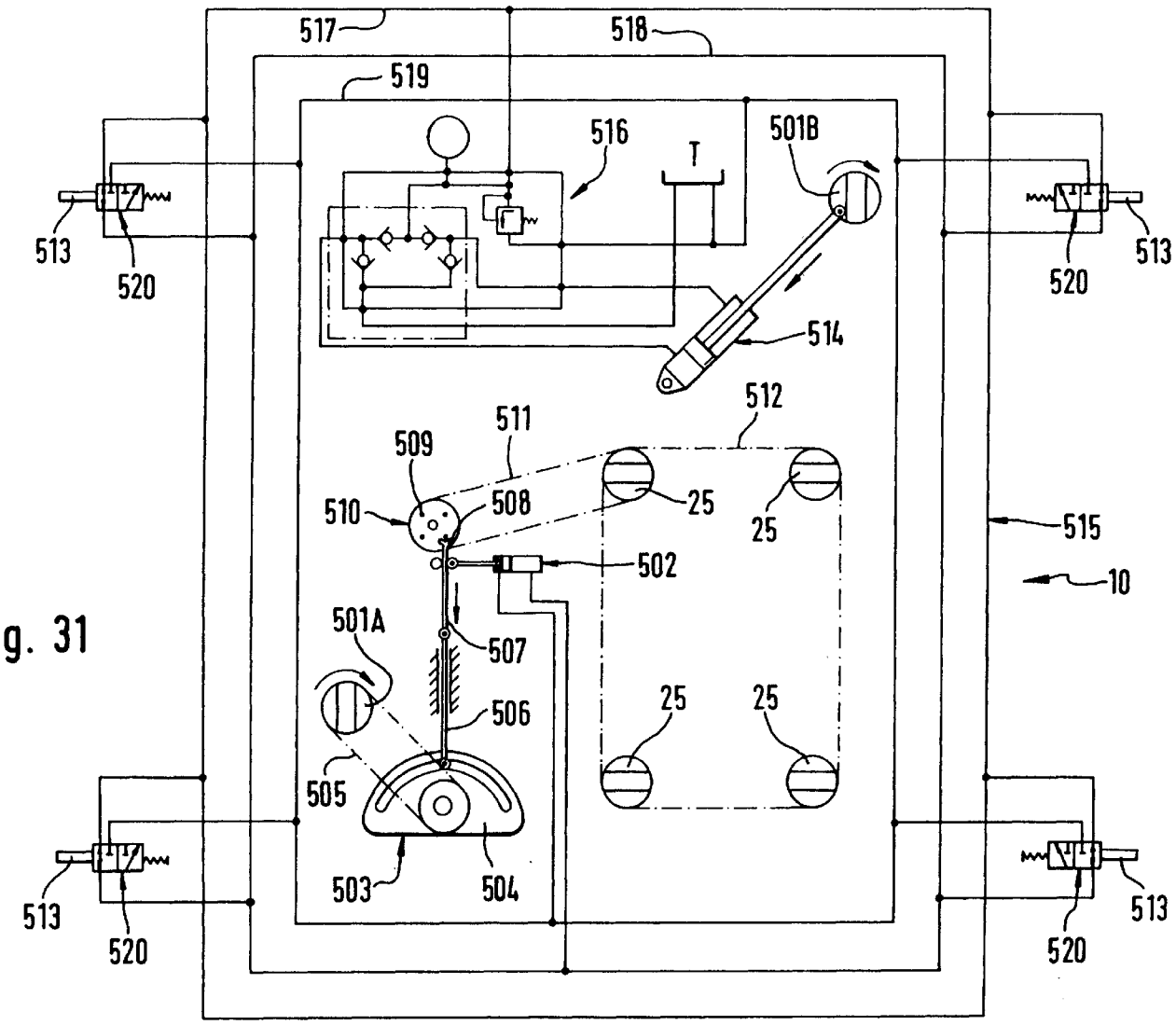
Figure 32:
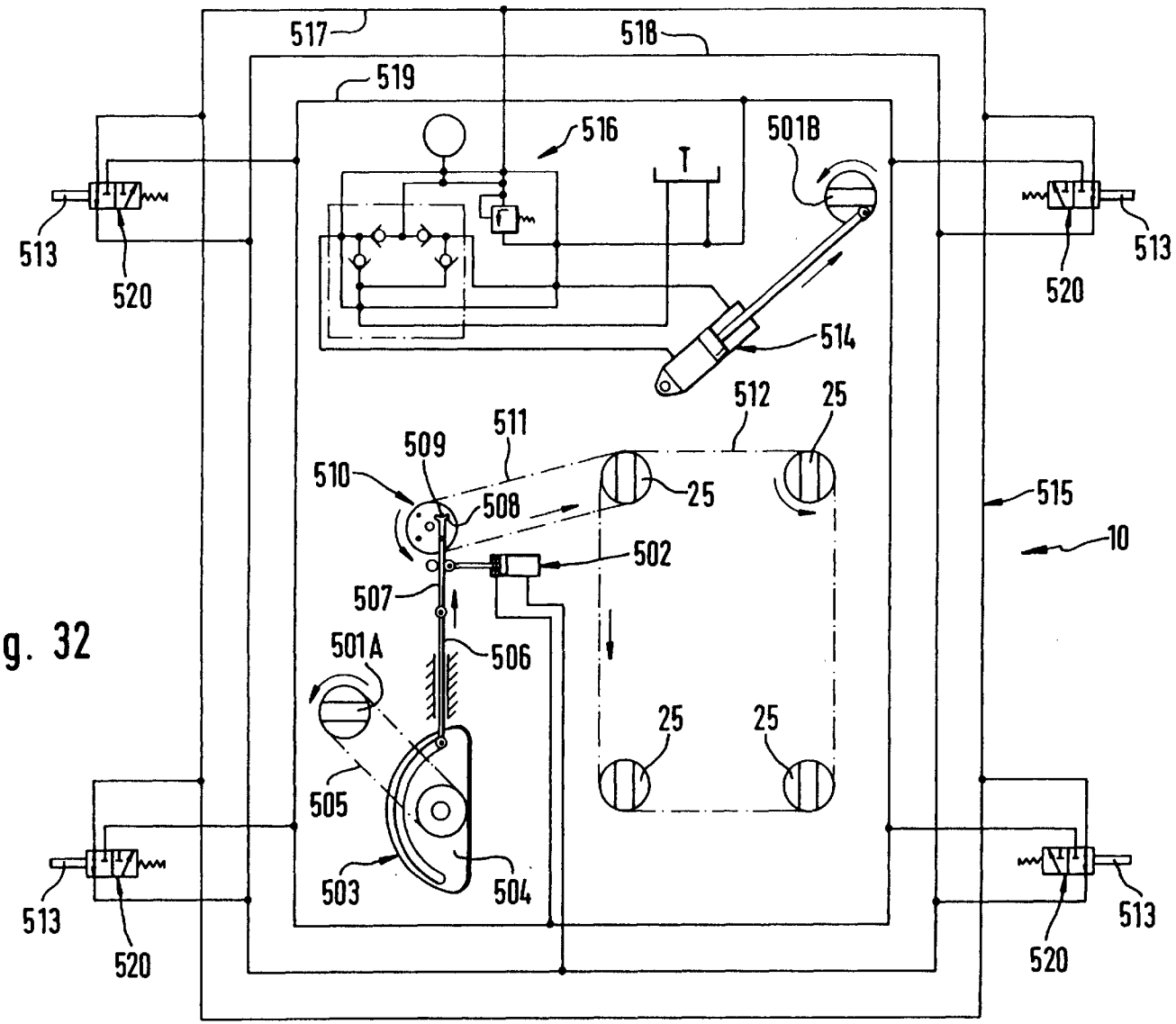
Figure 33:
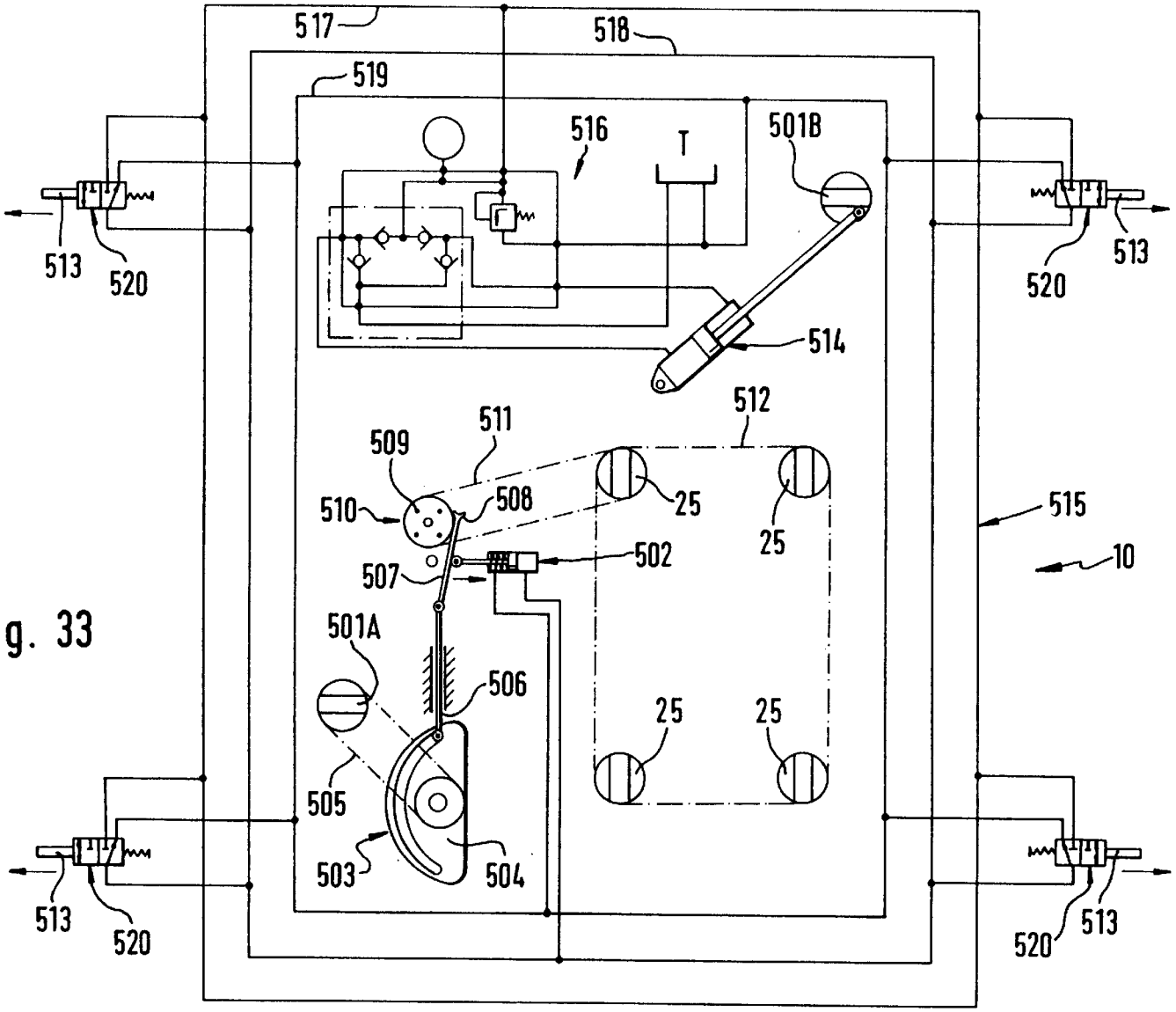
Figure 34:
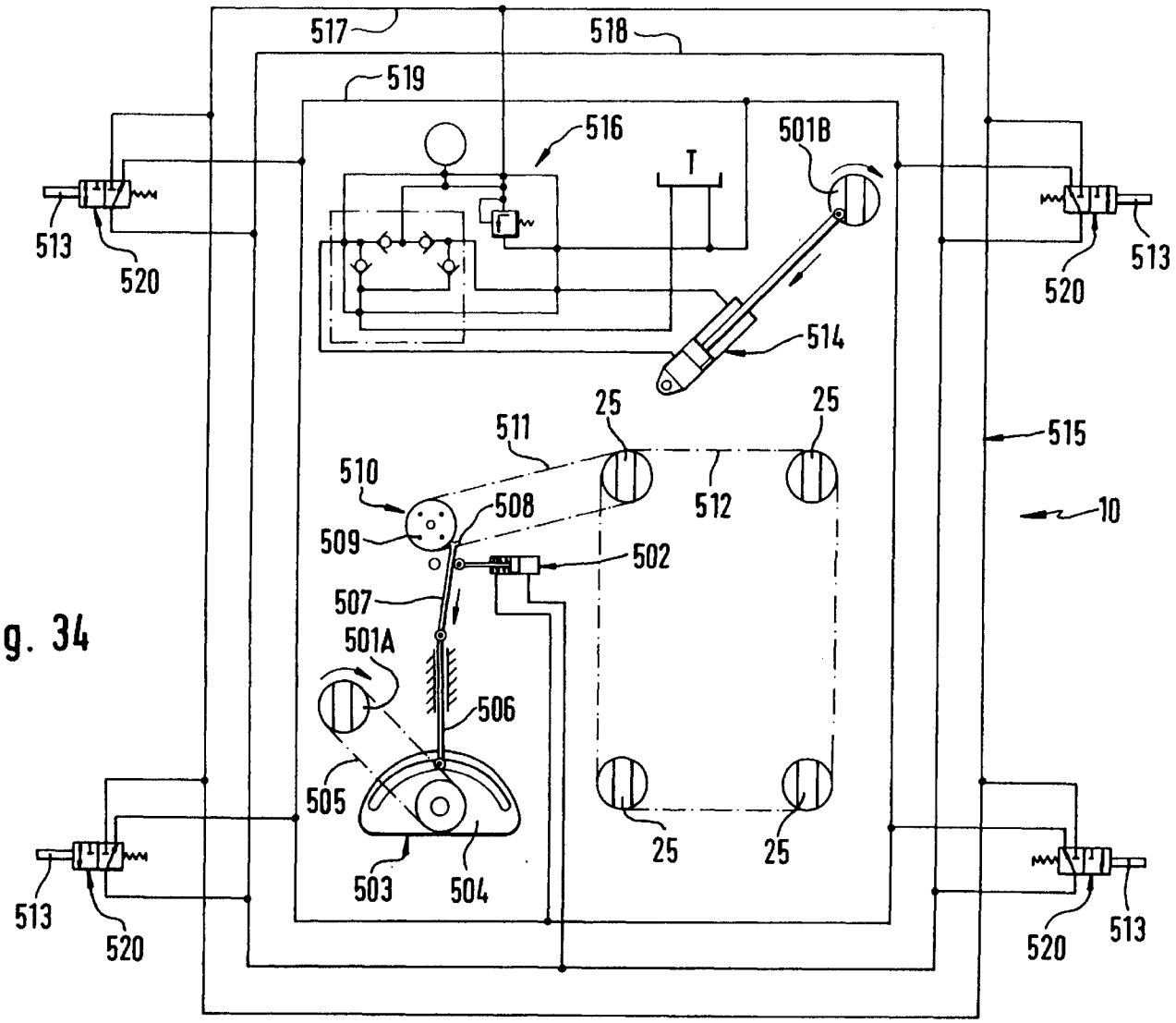

In order to again pick up the stilting frame 20 coupled with the container 40, the transhipment equipment 30 is again placed on the stilting frame 20 and another locking process in accordance with the representation of FIG. 28 is performed. As the indicator pins 513 are pushed further, the translatory movement of the pushing member 506 is transferred to the actuator 510, resulting in disengagement of the latch bolts 25 of the stilting frame 20 from the corner castings of the container 40. Accordingly the stilting frame 20 may be lifted off the container 40.

If, on the other hand, the entire assembly is to be moved jointly, renewed disengagement of the transhipment equipment 30 is required in order to take the pushing member 506 of the mechanical switch 503 into a position in which renewed locking of the transhipment equipment 30 results in a rotating movement of the actuator 510. In accordance with the representations of FIGS. 29 and 30 this has the effect that, following renewed locking of the transhipment equipment 30 to the stilting frame 20, the latter is also locked to the container 40.

In order to set down the container 40 while at the same time coupling the stilting frame 20 to the transhipment equipment 30, it is initially necessary to again disengage the transhipment equipment 30. Hereby, the pushing member 506 is taken to its home position, and following renewed locking of the transhipment equipment 30 on the stilting frame 20, another rotating movement of the actuator 510 is effected. This causes the latch bolts 25 of the stilting frame 20 to get out of engagement with the container 40 arranged underneath. The stilting frame 20 may then be lifted off the container 40 together with the transhipment equipment 30 (cf. FIGS. 31 and 32).

Hereby, engagement of the indicator pins 513 with the container 40 is cancelled, and the indicator valves 520 are actuated to cause the control line 518 to be relived via the tank line 519. Accordingly, the hydraulic switch 502 is deactivated and the pivotable portion 507 of the pushing member 506 disengages from the actuating element 509 (cf. FIG. 33).

In order to set down the stilting frame 20 it is then only necessary to unlock the transhipment equipment 30. This unlocking does not cause another rotating movement of the latch bolts 25 of the stilting frame 20 (cf. FIG. 34).

While the respective rotating movements of the switching member 501 are performed, steady pressure is generated by the switching member 501 B via the hydraulic cylinder 514 and input into the pressure line 517 via the valve assembly 516.

Actuation of the mechanical switch 503 and of the hydraulic cylinder 514 may originate from a single switching member 501, or several switching members. Thus, it is conceivable to combine the energy applied by the rotating movement of the single latch bolts 32 to thereby achieve a higher energy yield.

Apart from the embodiments represented here, the invention also allows for further approaches to designing the stilting frame.

Thus, the position of the indicator pins 221 may also be transmitted electrically to the control unit 202. A hydraulic actuating force from the indicator pin position directly to the disks or to the control elements of the control unit 202 is also possible.

The teeth of the spiral-jaw clutch may alternatively be arranged tangentially to serve the same function.

Furthermore, the stilting frame may be of the telescopic type, such that containers of various sizes may be coupled to it. In this case, the side rails or the transverse members would have to be designed to be adjustable.

The control unit 202 might equally be arranged in a corner post 21 instead of centrally in the transverse members 23. From there, actuation of the lock-on devices 10 in the other corner posts 21 could also be determined via the side rails and transverse members 23 and 22 of the stilting frame 20.

The invention thus furnishes a stilting frame 20 for transporting containers 40, which is designed in such a way that in total four combined positions between the latch bolts 32 of the transhipment equipment 30 and the latch bolts 25 of the stilting frame 20 may be obtained from both switching positions of the latch bolts 32 of the transhipment equipment 30. The stilting frame 20 may thus be operated in a fully automatic manner and the operator may easily determine whether only the stilting frame 20 is joined to the transhipment equipment 30, whether the container 40 is also joined to the stilting frame 20, or whether or not all three elements are joined to each other.

What is claimed is:

1. A stilting frame for the transport of containers, comprising:

four corner posts, each of said four corner posts having at an upper end thereof a casting for receiving a latch bolt of a transport equipment, and at a lower end thereof a post latch bolt engageable with a transportable container; and a switching member disposed in at least one of said castings, said switching member actuatable by the latch bolt of the transport equipment, and in operational connection with one of said post latch bolts of said four corner posts, wherein the operational connection between said switching member and said one of said post latch bolts is functional in that a set position of said one of said post latch bolts is not affected when said switching member is actuated to an unlocked position by way of the latch bolt of the transport equipment, and when said switching member is then actuated to a locked position by way of the latch bolt of the transport equipment, said set position of said one of said post latch bolts is thereby affected.

2. The stilting frame according to claim 1, wherein said switching member is actuated by way of rotational movement.

3. The stilting frame according to claim 1, wherein a drive mechanism is interposed between said switching member of said stilting frame and a control element for said one of said post latch bolts, said drive mechanism being systematically controllable in such a way that every second initiated movement of said switching member is converted into a switching movement of said one of said post latch bolts.

4. The stilting frame according to claim 3, wherein said drive mechanism includes a hydraulic switch and a mechanical switch, said drive mechanism transmits a forced movement of said switching member when said hydraulic switch is activated and said mechanical switch is actuated from disengagement with the transport equipment to engagement therewith.

5. The stilting frame according to claim 4, wherein said mechanical switch is a cam drive having a cam plate and a pushing member coupled thereto, said cam plate being driven by said switching member by means of a chain.

6. The stilting frame according to claim 5, wherein said cam plate is pivotable in either direction starting out from said unlocked position of said switching member.

7. The stilting frame according to claim 6, wherein said pushing member comprises a pivotable portion having at its free end an engagement member which, in one switching position, positively acts on actuating elements arranged at a radial distance from the center thereof on a rotatable actuator, a position of said pivotable portion being determined by said hydraulic switch.

8. The stilting frame according to claim 7, wherein actuation of said actuator is transmitted by means of a transmission member to said one of said post latch bolts.

9. The stilting frame according to claim 8, wherein application of pressure to said hydraulic switch is performed by a hydraulic cylinder actuated by means of said switching member.

10. The stilting frame according to claim 9, wherein the pivoting movement of said switching member is utilized for actuating said hydraulic cylinder.

11. The stilting frame according to claim 9, wherein said hydraulic cylinder is a work chamber for generating pressure on each side of the piston.

12. The stilting frame according to claim 1, wherein a switching member is disposed in said casting of each of said four corner posts, each switching member being in operational connection with a respective one of said post latch bolts, wherein the operational connection between said each switching member and each post latch bolt is functional in that a set position of said each post latch bolt is not affected when a respective switching member is actuated to an unlocked position by way of one of a plurality of latch bolts of the transport equipment, and when said each respective switching member is then actuated to a locked position by way of the one of a plurality of latch bolts of the transport equipment, said set position of said each post latch bolt is thereby affected.

13. The stilting frame according to claim 12, wherein each switching member includes a rotatable actuator and a linearly translatable control element.

14. The stilting frame according to claim 13, wherein said actuator and said control element of said each switching member comprise complementary teeth having inclined surfaces and horizontal surfaces.

15. The stilting frame according to claim 13, wherein said each switching member further includes a spiral-jaw clutch having a linearly translatable driving member rotatable with said control element, and a rotatable switching member actuatable with said driving member.

16. The stilting frame according to claim 15, wherein said driving member and said each switching member each include complementary teeth with inclined surfaces and vertical surfaces.

17. The stilting frame according to claim 15, wherein said driving member of said spiral-jaw clutch comprises a slot vertically oriented at an angle, and arranged transversely with respect to the rotation axis of said driving member.

18. The stilting frame according to claim 15, wherein said each switching member has a greater diameter than said spiral-jaw clutch.

19. The stilting frame according to claim 12, wherein the operational connection between each switching member and each post latch bolt is engageable and disengageable.

20. The stilting frame according to claim 19, wherein said each switching member further includes a spiral-jaw clutch having a linearly translatable driving member and control element, and a rotatable switching member, wherein said driving member is rotatable with said control element member, and is an actuation means for said rotatable switching member.

21. The stilting frame according to claim 20, wherein said each operational connection may be engaged and disengaged by a control unit which responds only to engagement of said each post latch bolt with said transport container.

22. The stilting frame according to claim 21, wherein said control unit includes at each of said corner posts an indicator pin and a lever mechanism, lever mechanisms of two corner posts being coupled to disks by means of transmission rods, and said disks in turn being coupled to each other through coupling rods.

23. The stilting frame according to claim 22, wherein each indicator pin and each transmission rod are provided with spring means.

24. The stilting frame according to claim 23, wherein said spring means of said each indicator pin are designed to have a higher elastic force than the spring means of said each transmission rod.

25. The stilting frame according to claim 24, wherein said each operational connection includes a pivotable push rod arranged between said control element and said driving member.

26. The stilting frame according to claim 25, wherein said push rod can be pivoted into its operative position only when said each indicator pin is pushed and thus said each transmission rod is released from said disks.

27. The stilting frame according to claim 22, wherein said coupling rods and said each transmission rod are of a telescopic design.

28. The stilting frame according to claim 1, wherein said switching member and said one of said post latch bolts are mechanically operational.

* * * * *